US008459768B2

(12) United States Patent
Hasenbein et al.

(10) Patent No.: US 8,459,768 B2
(45) **Date of Patent: *Jun. 11, 2013**

(54) HIGH FREQUENCY DROPLET EJECTION DEVICE AND METHOD

(75) Inventors: Robert A. Hasenbein, Enfield, NH (US); Paul A. Hoisington, Norwich, VT (US); Deane A. Gardner, Cupertino, CA (US); Steven H. Barss, Wilmot Flat, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 471 days.

This patent is subject to a terminal disclaimer.

(21) Appl. No.: 11/864,250

(22) Filed: Sep. 28, 2007

(65) Prior Publication Data

US 2008/0074451 A1 Mar. 27, 2008

Related U.S. Application Data

(63) Continuation of application No. 10/800,467, filed on Mar. 15, 2004, now Pat. No. 7,281,778.

(51) Int. Cl.
*B41J 29/38* (2006.01)

(52) U.S. Cl.
USPC ..... 347/11

(58) Field of Classification Search
USPC ..... 347/10, 11, 68, 70, 9
See application file for complete search history.

(56) References Cited

U.S. PATENT DOCUMENTS

| | | | |
|---|---|---|---|
| 2,892,107 | A | 6/1959 | Gravley et al. |
| 3,946,398 | A | 3/1976 | Kyser et al. |
| 4,005,440 | A | 1/1977 | Amberntsson |
| 4,051,582 | A | 10/1977 | Eschler et al. |
| 4,104,646 | A | 8/1978 | Fischbeck |
| 4,106,976 | A | 8/1978 | Chiou et al. |
| 4,158,847 | A | 6/1979 | Heinzl et al. |
| 4,189,734 | A | 2/1980 | Kyser et al. |
| 4,216,483 | A | 8/1980 | Kyser et al. |
| 4,266,232 | A | 5/1981 | Juliana, Jr. et al. |
| 4,339,763 | A | 7/1982 | Kyser et al. |
| 4,353,079 | A | 10/1982 | Kawanabe |
| 4,355,256 | A | 10/1982 | Perduijn et al. |
| 4,393,384 | A | 7/1983 | Kyser |
| 4,396,923 | A | 8/1983 | Noda |

(Continued)

FOREIGN PATENT DOCUMENTS

| | | |
|---|---|---|
| CN | 101094770 A | 12/2007 |
| DE | 100 11 366 | 1/2001 |

(Continued)

OTHER PUBLICATIONS

European Search Report dated Mar. 26, 2008.

(Continued)

*Primary Examiner* — Julian Huffman
(74) *Attorney, Agent, or Firm* — Fish & Richardson P.C.

(57) ABSTRACT

In general, in one aspect, the invention features a method for driving a droplet ejection device having an actuator, including applying a multipulse waveform that includes two or more drive pulses to the actuator to cause the droplet ejection device to eject a single droplet of a fluid, wherein a frequency of the drive pulses is greater than a natural frequency, fj, of the droplet ejection device.

24 Claims, 16 Drawing Sheets

U.S. PATENT DOCUMENTS

| | | | |
|---|---|---|---|
| 4,409,596 | A | 10/1983 | Ishii |
| 4,480,259 | A | 10/1984 | Kruger et al. |
| 4,492,968 | A | 1/1985 | Lee et al. |
| 4,504,845 | A | 3/1985 | Kattner et al. |
| 4,510,503 | A | 4/1985 | Paranjpe et al. |
| 4,513,299 | A | 4/1985 | Lee |
| 4,516,140 | A | 5/1985 | Durkee et al. |
| 4,523,200 | A | 6/1985 | Howkins |
| 4,528,574 | A | 7/1985 | Boyden |
| 4,563,689 | A | 1/1986 | Murakami et al. |
| 4,584,590 | A | 4/1986 | Fischbeck et al. |
| 4,620,123 | A | 10/1986 | Farrall et al. |
| 4,627,138 | A | 12/1986 | Im |
| 4,639,735 | A | 1/1987 | Yamamoto et al. |
| 4,641,153 | A | 2/1987 | Cruz-Uribe |
| 4,665,409 | A | 5/1987 | Behrens et al. |
| 4,670,074 | A | 6/1987 | Broussoux et al. |
| 4,672,398 | A | 6/1987 | Kuwabara et al. |
| 4,680,595 | A | 7/1987 | Cruz-Uribe et al. |
| 4,686,539 | A | 8/1987 | Schmidle et al. |
| 4,695,852 | A | 9/1987 | Scardovi |
| 4,695,854 | A | 9/1987 | Cruz-Uribe |
| 4,703,333 | A | 10/1987 | Hubbard |
| 4,714,935 | A | 12/1987 | Yamamoto et al. |
| 4,717,927 | A | 1/1988 | Sato |
| 4,726,099 | A | 2/1988 | Card et al. |
| 4,728,969 | A | 3/1988 | Le et al. |
| 4,730,197 | A | 3/1988 | Raman et al. |
| 4,769,653 | A | 9/1988 | Shimoda |
| 4,774,530 | A | 9/1988 | Hawkins |
| 4,789,425 | A | 12/1988 | Drake et al. |
| 4,812,199 | A | 3/1989 | Sickafus |
| 4,835,554 | A | 5/1989 | Hoisington et al. |
| 4,863,560 | A | 9/1989 | Hawkins |
| 4,891,654 | A | 1/1990 | Hoisington et al. |
| 4,899,178 | A | 2/1990 | Tellier |
| 4,966,037 | A | 10/1990 | Sumner et al. |
| 4,972,211 | A | 11/1990 | Aoki |
| 4,987,429 | A | 1/1991 | Finley et al. |
| 5,000,811 | A | 3/1991 | Campanelli |
| 5,023,625 | A | 6/1991 | Bares et al. |
| 5,041,190 | A | 8/1991 | Drake et al. |
| 5,096,535 | A | 3/1992 | Hawkins et al. |
| 5,109,233 | A | 4/1992 | Nishikawa |
| 5,124,717 | A | 6/1992 | Campanelli et al. |
| 5,124,722 | A | 6/1992 | Moriyama et al. |
| 5,172,134 | A | 12/1992 | Kishida et al. |
| 5,172,139 | A | 12/1992 | Sekiya et al. |
| 5,172,141 | A | 12/1992 | Moriyama |
| 5,173,717 | A | 12/1992 | Kishida et al. |
| 5,202,659 | A | 4/1993 | Debonte |
| 5,202,703 | A | 4/1993 | Hoisington et al. |
| 5,204,690 | A | 4/1993 | Lorenze, Jr. et al. |
| 5,204,695 | A | 4/1993 | Tokunaga et al. |
| 5,221,931 | A | 6/1993 | Moriyama |
| 5,223,937 | A | 6/1993 | Moriguchi et al. |
| 5,227,813 | A | 7/1993 | Pies et al. |
| 5,235,352 | A | 8/1993 | Pies et al. |
| 5,264,865 | A | 11/1993 | Shimoda et al. |
| 5,265,315 | A | 11/1993 | Hoisington et al. |
| 5,278,585 | A | 1/1994 | Karz et al. |
| 5,280,310 | A | 1/1994 | Otsuka et al. |
| 5,285,215 | A | 2/1994 | Liker |
| 5,298,923 | A | 3/1994 | Tokunaga et al. |
| 5,305,024 | A | 4/1994 | Moriguchi et al. |
| 5,329,293 | A | 7/1994 | Liker |
| 5,353,051 | A | 10/1994 | Katayama et al. |
| 5,354,135 | A | 10/1994 | Sakagami et al. |
| 5,361,084 | A | 11/1994 | Paton |
| 5,371,520 | A | 12/1994 | Kubota |
| 5,374,332 | A | 12/1994 | Koyama et al. |
| 5,376,856 | A | 12/1994 | Takeuchi et al. |
| 5,376,857 | A | 12/1994 | Takeuchi et al. |
| 5,381,166 | A | 1/1995 | Lam et al. |
| 5,385,635 | A | 1/1995 | O'Neill |
| 5,387,314 | A | 2/1995 | Baughman et al. |
| 5,402,926 | A | 4/1995 | Takeuchi et al. |
| 5,406,682 | A | 4/1995 | Zimnicki et al. |
| 5,408,739 | A | 4/1995 | Altavela et al. |
| 5,414,916 | A | 5/1995 | Hayes |
| 5,430,344 | A | 7/1995 | Takeuchi et al. |
| 5,438,350 | A | 8/1995 | Kerry |
| 5,446,484 | A | 8/1995 | Hoisington et al. |
| 5,459,501 | A | 10/1995 | Lee et al. |
| 5,463,413 | A | 10/1995 | Ho et al. |
| 5,463,414 | A | 10/1995 | Temple et al. |
| 5,463,416 | A | 10/1995 | Paton et al. |
| 5,466,985 | A | 11/1995 | Suzuki |
| 5,475,279 | A | 12/1995 | Takeuchi et al. |
| 5,477,246 | A | 12/1995 | Hirabayashi et al. |
| 5,477,344 | A | 12/1995 | Lubinsky et al. |
| 5,484,507 | A | 1/1996 | Ames |
| 5,489,930 | A | 2/1996 | Anderson |
| 5,495,270 | A | 2/1996 | Burr et al. |
| 5,500,988 | A | 3/1996 | Moynihan et al. |
| 5,501,893 | A | 3/1996 | Laermer et al. |
| 5,502,471 | A | 3/1996 | Obermeier et al. |
| 5,510,816 | A | 4/1996 | Hosono et al. |
| 5,512,793 | A | 4/1996 | Takeuchi et al. |
| 5,512,922 | A | 4/1996 | Paton |
| 5,518,952 | A | 5/1996 | Vonasek et al. |
| 5,552,809 | A | 9/1996 | Hosono et al. |
| 5,576,743 | A | 11/1996 | Momose et al. |
| 5,581,286 | A | 12/1996 | Hayes et al. |
| 5,581,288 | A | 12/1996 | Shimizu et al. |
| 5,592,042 | A | 1/1997 | Takuchi et al. |
| 5,594,476 | A | 1/1997 | Tokunaga et al. |
| 5,605,659 | A | 2/1997 | Moynihan et al. |
| 5,617,127 | A | 4/1997 | Takeuchi et al. |
| 5,622,748 | A | 4/1997 | Takeuchi et al. |
| 5,631,040 | A | 5/1997 | Takuchi et al. |
| 5,631,675 | A | 5/1997 | Futagawa |
| 5,640,184 | A | 6/1997 | Moynihan et al. |
| 5,643,379 | A | 7/1997 | Takeuchi et al. |
| 5,655,538 | A | 8/1997 | Lorraine et al. |
| 5,657,060 | A | 8/1997 | Sekiya et al. |
| 5,657,063 | A | 8/1997 | Takahashi |
| 5,658,471 | A | 8/1997 | Murthy et al. |
| 5,659,346 | A | 8/1997 | Moynihan |
| 5,665,249 | A | 9/1997 | Burke et al. |
| 5,666,143 | A | 9/1997 | Burke et al. |
| 5,670,999 | A | 9/1997 | Takeuchi et al. |
| 5,689,291 | A | 11/1997 | Tence et al. |
| 5,691,593 | A | 11/1997 | Takeuchi et al. |
| 5,691,594 | A | 11/1997 | Takeuchi et al. |
| 5,691,752 | A | 11/1997 | Moynihan et al. |
| 5,704,105 | A | 1/1998 | Venkataramani et al. |
| 5,710,584 | A | 1/1998 | Suzuki et al. |
| 5,718,044 | A | 2/1998 | Baughman et al. |
| 5,724,082 | A | 3/1998 | Moynihan |
| 5,729,257 | A | 3/1998 | Sekiya et al. |
| 5,731,828 | A | 3/1998 | Ishinaga et al. |
| 5,734,399 | A | 3/1998 | Weber et al. |
| 5,736,993 | A | 4/1998 | Regimbal et al. |
| 5,739,828 | A | 4/1998 | Moriyama et al. |
| 5,745,131 | A | 4/1998 | Kneezel et al. |
| 5,752,303 | A | 5/1998 | Thiel et al. |
| 5,754,204 | A | 5/1998 | Kitahara |
| 5,755,909 | A | 5/1998 | Gailus |
| 5,757,400 | A | 5/1998 | Hoisington |
| 5,777,639 | A | 7/1998 | Kageyama et al. |
| 5,790,156 | A | 8/1998 | Mutton et al. |
| 5,793,394 | A | 8/1998 | Kato |
| 5,798,772 | A | 8/1998 | Tachihara et al. |
| 5,818,476 | A | 10/1998 | Mey et al. |
| 5,818,482 | A | 10/1998 | Ohta et al. |
| 5,821,841 | A | 10/1998 | Furlani et al. |
| 5,821,953 | A | 10/1998 | Nakano et al. |
| 5,821,972 | A | 10/1998 | Mey et al. |
| 5,825,385 | A | 10/1998 | Silverbrook |
| 5,834,880 | A | 11/1998 | Venkataramani et al. |
| 5,841,452 | A | 11/1998 | Silverbrook |
| D402,687 | S | 12/1998 | Sabonis |
| 5,850,241 | A | 12/1998 | Silverbrook |
| 5,852,860 | A | 12/1998 | Lorraine et al. |
| 5,855,049 | A | 1/1999 | Corbett, III et al. |
| 5,861,902 | A | 1/1999 | Beerling |

D405,822 S 2/1999 Sabonis
5,870,123 A 2/1999 Lorenze, Jr. et al.
5,870,124 A 2/1999 Silverbrook
5,871,656 A 2/1999 Silverbrook
5,880,759 A 3/1999 Silverbrook
5,883,651 A 3/1999 Thiel et al.
5,889,544 A 3/1999 Mey et al.
5,901,425 A 5/1999 Bibl et al.
5,903,286 A 5/1999 Takahashi
5,907,340 A 5/1999 Katakura
5,927,206 A 7/1999 Bacon et al.
5,933,170 A 8/1999 Takeuchi et al.
5,946,012 A 8/1999 Courian et al.
D417,233 S 11/1999 Sabonis
5,975,667 A 11/1999 Moriguchi et al.
5,980,015 A 11/1999 Saruta
5,988,785 A 11/1999 Katayama
5,997,122 A 12/1999 Moriyama et al.
5,997,123 A 12/1999 Takekoshi et al.
6,007,174 A 12/1999 Hirabayashi et al.
6,012,799 A 1/2000 Silverbrook
6,019,457 A 2/2000 Silverbrook
6,020,905 A 2/2000 Cornell et al.
6,022,101 A 2/2000 Sabonis
6,022,752 A 2/2000 Hirsh et al.
6,029,896 A 2/2000 Self et al.
6,030,065 A 2/2000 Fukuhata
6,031,652 A 2/2000 Furlani et al.
6,033,060 A 3/2000 Minami
6,036,874 A 3/2000 Farnaam
6,037,957 A 3/2000 Grande et al.
6,039,425 A 3/2000 Sekiya et al.
6,042,219 A 3/2000 Higashino et al.
6,044,646 A 4/2000 Silverbrook
6,045,710 A 4/2000 Silverbrook
6,046,822 A 4/2000 Wen et al.
6,047,600 A 4/2000 Ottosson
6,047,816 A 4/2000 Moghadam et al.
6,059,394 A 5/2000 Moriyama
6,062,681 A 5/2000 Field et al.
6,067,183 A 5/2000 Furlani et al.
6,070,310 A 6/2000 Ito et al.
6,070,959 A 6/2000 Kanbayashi et al.
6,071,750 A 6/2000 Silverbrook
6,071,822 A 6/2000 Donohue et al.
6,074,033 A 6/2000 Sayama et al.
6,084,609 A 7/2000 Manini et al.
6,086,189 A 7/2000 Hosono et al.
6,087,638 A 7/2000 Silverbrook
6,088,148 A 7/2000 Furlani et al.
6,089,690 A 7/2000 Hotomi
6,089,696 A 7/2000 Lubinsky
6,092,886 A 7/2000 Hosono
6,095,630 A 8/2000 Horii et al.
6,097,406 A 8/2000 Lubinsky et al.
6,099,103 A 8/2000 Takahashi
6,102,512 A 8/2000 Torii et al.
6,102,513 A 8/2000 Wen
6,106,091 A 8/2000 Osawa et al.
6,106,092 A 8/2000 Norigoe et al.
6,108,117 A 8/2000 Furlani et al.
6,109,746 A 8/2000 Jeanmaire et al.
6,113,209 A 9/2000 Nitta et al.
6,116,709 A 9/2000 Hirabayashi et al.
6,123,405 A 9/2000 Temple et al.
6,126,259 A 10/2000 Stango et al.
6,126,263 A 10/2000 Hotomi et al.
6,126,846 A 10/2000 Silverbrook
6,127,198 A 10/2000 Coleman et al.
6,140,746 A 10/2000 Miyashita et al.
6,143,190 A 11/2000 Yagi et al.
6,143,432 A 11/2000 deRochemont et al.
6,143,470 A 11/2000 Nguyen et al.
6,149,259 A 11/2000 Otsuka et al.
6,149,260 A 11/2000 Minakuti
6,151,050 A 11/2000 Hosono et al.
6,155,671 A 12/2000 Fukumoto et al.
6,161,270 A 12/2000 Ghosh et al.
6,174,038 B1 1/2001 Nakazawa et al.
6,176,570 B1 1/2001 Kishima et al.
6,179,978 B1 1/2001 Hirsh et al.
6,186,618 B1 2/2001 Usui et al.
6,188,416 B1 2/2001 Hayes
6,188,610 B1 2/2001 Kocher et al.
6,190,931 B1 2/2001 Silverbrook
6,193,343 B1 2/2001 Norigoe et al.
6,193,346 B1 2/2001 Nakano
6,193,348 B1 2/2001 Sekiya et al.
6,209,999 B1 4/2001 Wen et al.
6,213,588 B1 4/2001 Silverbrook
6,214,192 B1 4/2001 Hawkins et al.
6,214,244 B1 4/2001 Silverbrook
6,214,245 B1 4/2001 Hawkins et al.
6,217,141 B1 4/2001 Nakamura et al.
6,217,153 B1 4/2001 Silverbrook
6,217,155 B1 4/2001 Silverbrook
6,217,159 B1 4/2001 Morikoshi et al.
6,218,083 B1 4/2001 McCullough et al.
6,220,694 B1 4/2001 Silverbrook
6,227,653 B1 5/2001 Silverbrook
6,227,654 B1 5/2001 Silverbrook
6,228,668 B1 5/2001 Silverbrook
6,231,151 B1 5/2001 Hotomi et al.
6,234,608 B1 5/2001 Genovese et al.
6,234,611 B1 5/2001 Silverbrook
6,235,211 B1 5/2001 Silverbrook
6,235,212 B1 5/2001 Silverbrook
6,238,044 B1 5/2001 Silverbrook et al.
6,238,115 B1 5/2001 Silverbrook et al.
6,238,584 B1 5/2001 Hawkins et al.
6,239,821 B1 5/2001 Silverbrook
6,241,342 B1 6/2001 Silverbrook
6,241,904 B1 6/2001 Silverbrook
6,241,905 B1 6/2001 Silverbrook
6,241,906 B1 6/2001 Silverbrook
6,244,691 B1 6/2001 Silverbrook
6,245,246 B1 6/2001 Silverbrook
6,245,247 B1 6/2001 Silverbrook
6,247,776 B1 6/2001 Usui et al.
6,247,790 B1 6/2001 Silverbrook
6,247,791 B1 6/2001 Silverbrook
6,247,793 B1 6/2001 Silverbrook
6,247,794 B1 6/2001 Silverbrook
6,247,795 B1 6/2001 Silverbrook
6,247,796 B1 6/2001 Silverbrook
6,248,248 B1 6/2001 Silverbrook
6,248,249 B1 6/2001 Silverbrook
6,248,505 B1 6/2001 McCullough et al.
6,251,298 B1 6/2001 Silverbrook
6,252,697 B1 6/2001 Hawkins et al.
6,254,213 B1 7/2001 Ishikawa
6,254,793 B1 7/2001 Silverbrook
6,255,762 B1 7/2001 Sakamaki et al.
6,256,849 B1 7/2001 Kim
6,257,689 B1 7/2001 Yonekubo
6,258,284 B1 7/2001 Silverbrook
6,258,285 B1 7/2001 Silverbrook
6,258,286 B1 7/2001 Hawkins et al.
6,260,741 B1 7/2001 Pham-Van-Diep et al.
6,260,953 B1 7/2001 Silverbrook
6,263,551 B1 7/2001 Lorraine et al.
6,264,306 B1 7/2001 Silverbrook
6,264,307 B1 7/2001 Silverbrook
6,264,849 B1 7/2001 Silverbrook
6,267,905 B1 7/2001 Silverbrook
6,270,179 B1 8/2001 Nou
6,273,538 B1 8/2001 Mitsuhashi et al.
6,273,552 B1 8/2001 Hawkins et al.
6,274,056 B1 8/2001 Silverbrook
6,276,772 B1 8/2001 Sakata et al.
6,276,774 B1 8/2001 Moghadam et al.
6,276,782 B1 8/2001 Sharma et al.
6,280,643 B1 8/2001 Silverbrook
6,281,912 B1 8/2001 Silverbrook
6,281,913 B1 8/2001 Webb
6,283,568 B1 9/2001 Horii et al.
6,283,569 B1 9/2001 Otsuka et al.
6,283,575 B1 9/2001 Hawkins et al.

6,286,935 B1 9/2001 Silverbrook
6,290,315 B1 9/2001 Sayama
6,290,317 B1 9/2001 Hotomi
6,291,317 B1 9/2001 Salatino et al.
6,293,639 B1 9/2001 Isamoto
6,293,642 B1 9/2001 Sano
6,293,658 B1 9/2001 Silverbrook
6,294,101 B1 9/2001 Silverbrook
6,296,340 B1 10/2001 Tajika et al.
6,296,346 B1 10/2001 Seo et al.
6,299,272 B1 10/2001 Baket et al.
6,299,289 B1 10/2001 Silverbrook
6,299,300 B1 10/2001 Silverbrook
6,299,786 B1 10/2001 Silverbrook
6,303,042 B1 10/2001 Hawkins et al.
6,305,773 B1 10/2001 Burr et al.
6,305,788 B1 10/2001 Silverbrook
6,305,791 B1 10/2001 Hotomi et al.
6,306,671 B1 10/2001 Silverbrook
6,309,048 B1 10/2001 Silverbrook
6,309,054 B1 10/2001 Kawamura et al.
6,312,076 B1 11/2001 Taki et al.
6,312,096 B1 11/2001 Koitabashi et al.
6,312,114 B1 11/2001 Silverbrook
6,312,615 B1 11/2001 Silverbrook
6,315,399 B1 11/2001 Silverbrook
6,315,914 B1 11/2001 Silverbrook
6,318,849 B1 11/2001 Silverbrook
6,322,194 B1 11/2001 Silverbrook
6,322,195 B1 11/2001 Silverbrook
6,328,395 B1 12/2001 Kitahara et al.
6,328,397 B1 12/2001 Shimizu et al.
6,328,398 B1 12/2001 Chang
6,328,399 B1 12/2001 Wen
6,328,402 B1 12/2001 Hotomi
6,328,417 B1 12/2001 Silverbrook
6,328,425 B1 12/2001 Silverbrook
6,328,431 B1 12/2001 Silverbrook
6,331,040 B1 12/2001 Yonekubo et al.
6,331,258 B1 12/2001 Silverbrook
6,336,715 B1 1/2002 Hotomi et al.
6,338,542 B1 1/2002 Fujimori
6,338,548 B1 1/2002 Silverbrook
6,340,222 B1 1/2002 Silverbrook
6,345,424 B1 2/2002 Hasegawa
6,345,880 B1 2/2002 DeBoer et al.
6,350,003 B1 2/2002 Ishikawa
6,350,019 B1 2/2002 Shingai et al.
6,352,328 B1 3/2002 Wen et al.
6,352,330 B1 3/2002 Lubinsky et al.
6,352,335 B1 3/2002 Koyama et al.
6,352,337 B1 3/2002 Sharma
6,352,814 B1 3/2002 McCullough et al.
6,354,686 B1 3/2002 Tanaka et al.
6,357,846 B1 3/2002 Kitahara
6,364,444 B1 4/2002 Ota
6,364,459 B1 4/2002 Sharma et al.
6,371,587 B1 4/2002 Chang
6,378,971 B1 4/2002 Tamura et al.
6,378,972 B1 4/2002 Akiyama et al.
6,378,973 B1 4/2002 Kubota et al.
6,378,989 B1 4/2002 Silverbrook
6,378,996 B1 4/2002 Shimada et al.
6,382,753 B1 5/2002 Teramae et al.
6,382,754 B1 5/2002 Morikoshi et al.
6,382,767 B1 5/2002 Greive
6,382,779 B1 5/2002 Silverbrook
6,382,782 B1 5/2002 Anagnostopoulos et al.
6,383,833 B1 5/2002 Silverbrook
6,386,664 B1 5/2002 Hosono et al.
6,386,679 B1 5/2002 Yang et al.
6,393,980 B2 5/2002 Simons
6,394,570 B1 5/2002 Inada
6,394,581 B1 5/2002 Silverbrook
6,398,331 B1 6/2002 Asaka et al.
6,398,344 B1 6/2002 Silverbrook
6,398,348 B1 6/2002 Haluzak et al.
6,402,278 B1 6/2002 Temple
6,402,282 B1 6/2002 Webb
6,402,300 B1 6/2002 Silverbrook
6,402,303 B1 6/2002 Sumi
6,406,129 B1 6/2002 Silverbrook
6,406,607 B1 6/2002 Hirsh et al.
6,409,295 B1 6/2002 Norigoe
6,409,316 B1 6/2002 Clark et al.
6,409,323 B1 6/2002 Silverbrook
6,412,908 B2 7/2002 Silverbrook
6,412,912 B2 7/2002 Silverbrook
6,412,914 B1 7/2002 Silverbrook
6,412,925 B1 7/2002 Takahashi
6,413,700 B1 7/2002 Hallman
6,416,149 B2 7/2002 Takahashi
6,416,168 B1 7/2002 Silverbrook
6,416,932 B1 7/2002 Ray et al.
6,419,337 B2 7/2002 Sayama
6,419,339 B2 7/2002 Takahashi
6,420,196 B1 7/2002 Silverbrook
6,422,677 B1 7/2002 Deshpande et al.
6,425,651 B1 7/2002 Silverbrook
6,425,661 B1 7/2002 Silverbrook et al.
6,425,971 B1 7/2002 Silverbrook
6,428,133 B1 8/2002 Silverbrook
6,428,134 B1 8/2002 Clark et al.
6,428,135 B1 8/2002 Lubinsky et al.
6,428,137 B1 8/2002 Iwaishi et al.
6,428,138 B1 8/2002 Asauchi et al.
6,428,146 B1 8/2002 Sharma et al.
6,428,147 B2 8/2002 Silverbrook
6,431,675 B1 8/2002 Chang
6,431,676 B2 8/2002 Asauchi et al.
6,435,666 B1 8/2002 Trauernicht et al.
6,439,687 B1 8/2002 Inoue
6,439,695 B2 8/2002 Silverbrook
6,439,699 B1 8/2002 Silverbrook
6,439,701 B1 8/2002 Taneya et al.
6,439,703 B1 8/2002 Anagnostopoulos et al.
6,439,704 B1 8/2002 Silverbrook
6,443,547 B1 9/2002 Takahashi et al.
6,450,602 B1 9/2002 Lubinsky et al.
6,450,603 B1 9/2002 Chang
6,450,615 B2 9/2002 Kojima et al.
6,450,619 B1 9/2002 Anagnostopoulos et al.
6,450,627 B1 9/2002 Moynihan et al.
6,450,628 B1 9/2002 Jeanmaire et al.
6,451,216 B1 9/2002 Silverbrook
6,453,526 B2 9/2002 Lorraine et al.
6,454,396 B2 9/2002 Silverbrook
6,457,795 B1 10/2002 Silverbrook
6,457,807 B1 10/2002 Hawkins et al.
6,460,778 B1 10/2002 Silverbrook
6,460,959 B1 10/2002 Momose et al.
6,460,960 B1 10/2002 Mitsuhashi
6,463,656 B1 10/2002 Debesis et al.
6,464,315 B1 10/2002 Otokita et al.
6,467,865 B1 10/2002 Iwamura et al.
6,467,885 B2 10/2002 Tanaka
6,471,316 B1 10/2002 Seto
6,471,336 B2 10/2002 Silverbrook
6,474,762 B2 11/2002 Taki et al.
6,474,781 B1 11/2002 Jeanmaire
6,474,789 B1 11/2002 Ishinaga et al.
6,474,794 B1 11/2002 Anagnostopoulos et al.
6,474,795 B1 11/2002 Lebens et al.
6,478,395 B2 11/2002 Tanaka et al.
6,481,835 B2 11/2002 Hawkins et al.
6,485,123 B2 11/2002 Silverbrook
6,485,130 B2 11/2002 DeLouise et al.
6,485,133 B1 11/2002 Teramae et al.
6,488,349 B1 12/2002 Matsuo et al.
6,488,361 B2 12/2002 Silverbrook
6,488,367 B1 12/2002 Debesis et al.
6,491,362 B1 12/2002 Jeanmaire
6,491,376 B2 12/2002 Trauernicht et al.
6,491,385 B2 12/2002 Anagnostopoulos et al.
6,491,833 B1 12/2002 Silverbrook
6,494,554 B1 12/2002 Horii et al.
6,494,555 B1 12/2002 Ishikawa
6,494,556 B1 12/2002 Sayama et al.

6,494,566 B1 12/2002 Kishino et al.
6,497,019 B1 12/2002 Yun
6,499,820 B2 12/2002 Taki
6,502,306 B2 1/2003 Silverbrook
6,502,914 B2 1/2003 Hosono et al.
6,502,925 B2 1/2003 Anagnostopoulos et al.
6,503,408 B2 1/2003 Silverbrook
6,504,701 B1 1/2003 Takamura et al.
6,505,922 B2 1/2003 Hawkins et al.
6,507,099 B1 1/2003 Silverbrook
6,508,532 B1 1/2003 Hawkins et al.
6,508,543 B2 1/2003 Hawkins et al.
6,508,947 B2 1/2003 Gulvin et al.
6,513,894 B1 2/2003 Chen et al.
6,513,903 B2 2/2003 Sharma et al.
6,513,908 B2 2/2003 Silverbrook
6,517,176 B1 2/2003 Chaug
6,517,178 B1 2/2003 Yamamoto et al.
6,517,267 B1 2/2003 Otsuki
6,521,513 B1 2/2003 Lebens et al.
6,523,923 B2 2/2003 Sekiguchi
6,526,658 B1 3/2003 Silverbrook
6,527,354 B2 3/2003 Takahashi
6,527,357 B2 3/2003 Sharma et al.
6,527,365 B1 3/2003 Silverbrook
6,530,653 B2 3/2003 Le et al.
6,533,378 B2 3/2003 Ishikawa
6,533,390 B1 3/2003 Silverbrook
6,536,874 B1 3/2003 Silverbrook
6,536,883 B2 3/2003 Hawkins et al.
6,537,735 B1 3/2003 McCullough et al.
6,540,319 B1 4/2003 Silverbrook
6,540,332 B2 4/2003 Silverbrook
6,540,338 B2 4/2003 Takahashi et al.
6,546,628 B2 4/2003 Silverbrook
6,547,364 B2 4/2003 Silverbrook
6,547,371 B2 4/2003 Silverbrook
6,550,895 B1 4/2003 Silverbrook
6,553,651 B2 4/2003 Reznik et al.
6,554,410 B2 4/2003 Jeanmaire et al.
6,557,967 B1 5/2003 Lee
6,557,978 B2 5/2003 Silverbrook
6,561,608 B1 5/2003 Yamamoto et al.
6,561,614 B1 5/2003 Therien et al.
6,561,625 B2 5/2003 Maeng et al.
6,565,193 B1 5/2003 Silverbrook et al.
6,565,762 B1 5/2003 Silverbrook
6,566,858 B1 5/2003 Silverbrook et al.
6,568,797 B2 5/2003 Yamauchi et al.
6,572,210 B2 6/2003 Chaug
6,572,215 B2 6/2003 Sharma
6,572,715 B2 6/2003 Komine et al.
6,575,544 B2 6/2003 Iriguchi
6,575,549 B1 6/2003 Silverbrook
6,578,245 B1 6/2003 Chatterjee et al.
6,581,258 B2 6/2003 Yoneda et al.
6,582,043 B2 6/2003 Ishizaki
6,582,059 B2 6/2003 Silverbrook
6,588,882 B2 7/2003 Silverbrook
6,588,884 B1 7/2003 Furlani et al.
6,588,888 B2 7/2003 Jeanmaire et al.
6,588,889 B2 7/2003 Jeanmaire
6,588,890 B1 7/2003 Furlani et al.
6,588,952 B1 7/2003 Silverbrook et al.
6,594,898 B1 7/2003 Yun
6,595,617 B2 7/2003 Sharma et al.
6,595,620 B2 7/2003 Kubota et al.
6,599,757 B1 7/2003 Murai
6,629,739 B2 10/2003 Korol
6,629,756 B2 10/2003 Wang
6,641,744 B1 11/2003 Kawamura et al.
6,644,767 B2 11/2003 Silverbrook
6,655,795 B2 12/2003 Wachtel
6,659,583 B2 12/2003 Fujimori
6,672,704 B2 1/2004 Katakura et al.
6,682,170 B2 1/2004 Hotomi et al.
6,685,293 B2 2/2004 Junhua
6,755,511 B1 * 6/2004 Moynihan et al. ..... 347/68
6,767,085 B2 7/2004 Murai
6,779,866 B2 8/2004 Junhua et al.
6,789,866 B2 9/2004 Sekiya et al.
6,793,311 B2 * 9/2004 Baba et al. ..... 347/19
6,851,780 B2 2/2005 Fujimura et al.
6,857,715 B2 * 2/2005 Darling ..... 347/11
6,896,346 B2 5/2005 Trauernicht et al.
6,902,248 B2 6/2005 Koguchi
6,923,520 B2 8/2005 Oikawa et al.
7,011,396 B2 3/2006 Moynihan et al.
7,014,297 B2 3/2006 Miki et al.
7,052,117 B2 5/2006 Bibl et al.
7,195,327 B2 3/2007 Kitami et al.
7,281,778 B2 10/2007 Hasenbein et al.
7,303,264 B2 12/2007 Bibl et al.
7,478,899 B2 1/2009 Moynihan et al.
2001/0001458 A1 5/2001 Hashizume et al.
2001/0002135 A1 5/2001 Milligan et al.
2001/0002836 A1 6/2001 Tanaka et al.
2001/0007460 A1 7/2001 Fujii et al.
2001/0015001 A1 8/2001 Hashizume et al.
2001/0022596 A1 9/2001 Korol
2001/0023523 A1 9/2001 Kubby et al.
2001/0026294 A1 10/2001 Takahashi
2001/0028378 A1 10/2001 Lee et al.
2001/0032382 A1 10/2001 Lorraine et al.
2001/0033313 A1 10/2001 Ohno et al.
2001/0038404 A1 11/2001 Kitahara et al.
2001/0043241 A1 11/2001 Takahashi et al.
2002/0008738 A1 1/2002 Lee et al.
2002/0018082 A1 2/2002 Hosono et al.
2002/0018083 A1 2/2002 Sayama
2002/0018085 A1 2/2002 Asauchi et al.
2002/0018105 A1 2/2002 Usui et al.
2002/0024546 A1 2/2002 Chang
2002/0033644 A1 3/2002 Takamura et al.
2002/0033852 A1 3/2002 Chang
2002/0036666 A1 3/2002 Taki
2002/0036669 A1 3/2002 Hosono et al.
2002/0039117 A1 4/2002 Oikawa
2002/0041315 A1 4/2002 Kubota et al.
2002/0051039 A1 5/2002 Moynihan et al.
2002/0051042 A1 5/2002 Takagi et al.
2002/0054311 A1 5/2002 Kubo
2002/0057303 A1 5/2002 Takahashi et al.
2002/0060724 A1 5/2002 Le et al.
2002/0070992 A1 6/2002 Fukano
2002/0075360 A1 6/2002 Maeng et al.
2002/0080202 A1 6/2002 Sekiguchi
2002/0085065 A1 7/2002 Shimada et al.
2002/0089558 A1 7/2002 Suzuki et al.
2002/0096488 A1 7/2002 Gulvin et al.
2002/0096489 A1 7/2002 Lee et al.
2002/0097303 A1 7/2002 Gulvin et al.
2002/0101464 A1 8/2002 Iriguchi
2002/0109192 A1 8/2002 Hogyoku
2002/0122085 A1 9/2002 Chaug
2002/0122100 A1 9/2002 Nordstrom et al.
2002/0129478 A1 9/2002 Kishima
2002/0139235 A1 10/2002 Nordin et al.
2002/0145637 A1 10/2002 Umeda et al.
2002/0158926 A1 10/2002 Fukano
2002/0158927 A1 10/2002 Kojima
2002/0167559 A1 11/2002 Hosono et al.
2002/0184907 A1 12/2002 Vaiyapuri et al.
2003/0016272 A1 1/2003 Anagnostopoulos et al.
2003/0016275 A1 1/2003 Jeanmaire et al.
2003/0058309 A1 3/2003 Haluzak et al.
2003/0067500 A1 4/2003 Fujimura et al.
2003/0071138 A1 4/2003 Usuda
2003/0071869 A1 4/2003 Baba et al.
2003/0081025 A1 5/2003 Yonekubo
2003/0081040 A1 5/2003 Therien et al.
2003/0081073 A1 5/2003 Chen et al.
2003/0103095 A1 6/2003 Imai
2003/0107617 A1 6/2003 Okuda
2003/0107622 A1 6/2003 Sugahara
2003/0112297 A1 6/2003 Hiratsuka et al.
2003/0117465 A1 6/2003 Chwalek et al.
2003/0122885 A1 7/2003 Kobayashi

| | | | |
|---|---|---|---|
| 2003/0122888 | A1 | 7/2003 | Baba et al. |
| 2003/0122899 | A1 | 7/2003 | Okuda |
| 2003/0131475 | A1 | 7/2003 | Conta |
| 2003/0132823 | A1 | 7/2003 | Hyman et al. |
| 2003/0136002 | A1 | 7/2003 | Nishikawa et al. |
| 2003/0156157 | A1 | 8/2003 | Suzuki et al. |
| 2003/0156158 | A1 | 8/2003 | Hirota et al. |
| 2003/0156159 | A1 | 8/2003 | Kobayashi |
| 2003/0156162 | A1 | 8/2003 | Hirota et al. |
| 2003/0227497 | A1 | 12/2003 | Tamura |
| 2003/0234826 | A1 | 12/2003 | Hosono et al. |
| 2004/0004649 | A1 | 1/2004 | Bibl et al. |
| 2004/0027405 | A1 | 2/2004 | Stoessel et al. |
| 2004/0032467 | A1 | 2/2004 | Usui |
| 2004/0085374 | A1 | 5/2004 | Berger et al. |
| 2004/0113960 | A1 | 6/2004 | Usui |
| 2004/0155915 | A1 | 8/2004 | Kitami et al. |
| 2004/0207671 | A1 | 10/2004 | Kusunoki et al. |
| 2005/0035986 | A1 | 2/2005 | Iwao et al. |
| 2005/0093903 | A1 | 5/2005 | Darling |
| 2005/0200640 | A1 | 9/2005 | Hasenbein et al. |
| 2005/0280675 | A1 | 12/2005 | Bibl et al. |
| 2006/0181557 | A1 | 8/2006 | Hoisington et al. |
| 2007/0008356 | A1 | 1/2007 | Katoh |
| 2008/0074451 | A1 | 3/2008 | Hasenbein et al. |
| 2009/0079801 | A1 | 3/2009 | Moynihan et al. |
| 2010/0039479 | A1 | 2/2010 | Bibl et al. |

FOREIGN PATENT DOCUMENTS

| | | | |
|---|---|---|---|
| EP | 0413340 | | 2/1991 |
| EP | 0486256 | | 11/1991 |
| EP | 0 422 870 | | 1/1995 |
| EP | 0667239 | | 8/1995 |
| EP | 0709200 | | 5/1996 |
| EP | 0736915 | | 10/1996 |
| EP | 0719642 | | 12/1996 |
| EP | 0839655 | | 5/1998 |
| EP | 0855273 | | 7/1998 |
| EP | 0916497 | | 5/1999 |
| EP | 0916500 | | 5/1999 |
| EP | 0949079 | | 10/1999 |
| EP | 0 783 410 | | 1/2000 |
| EP | 0969530 | | 1/2000 |
| EP | 0 979 732 | | 2/2000 |
| EP | 0980103 | | 2/2000 |
| EP | 0 867 289 | | 3/2000 |
| EP | 0985534 | | 3/2000 |
| EP | 1004441 | | 5/2000 |
| EP | 1123806 | | 8/2001 |
| EP | 1138492 | | 10/2001 |
| EP | 0963296 | | 1/2002 |
| EP | 1 011 975 | | 4/2002 |
| EP | 0 983 145 | | 9/2002 |
| EP | 1241009 | | 9/2002 |
| EP | 0 973 644 | | 1/2003 |
| EP | 1284188 | | 2/2003 |
| EP | 1321294 | | 6/2003 |
| EP | 1 116 591 | | 5/2006 |
| EP | 1836056 | | 9/2007 |
| JP | 59-143652 | | 8/1984 |
| JP | 02-080252 | | 3/1990 |
| JP | 2-0175256 | | 7/1990 |
| JP | 02184447 | | 7/1990 |
| JP | 06-132756 | | 5/1994 |
| JP | 06-137438 | | 5/1994 |
| JP | 06-198876 | | 7/1994 |
| JP | 06-305141 | | 11/1994 |
| JP | 09-039232 | | 2/1997 |
| JP | 09-039234 | | 2/1997 |
| JP | 09-039238 | | 2/1997 |
| JP | 09-223831 | | 8/1997 |
| JP | 63-071355 | | 3/1998 |
| JP | 10-119260 | | 5/1998 |
| JP | H10-119260 | | 5/1998 |
| JP | 10-264385 | | 10/1998 |
| JP | 11-058737 | | 3/1999 |
| JP | 11-216880 | A | 8/1999 |
| JP | 11-227203 | * | 8/1999 |
| JP | 11-334088 | | 12/1999 |
| JP | 2000-516872 | | 12/2000 |
| JP | 2001-010040 | | 1/2001 |
| JP | 2001-088294 | | 4/2001 |
| JP | 2001-260355 | | 9/2001 |
| JP | 2001-334674 | | 12/2001 |
| JP | 2002-079668 | | 3/2002 |
| JP | 2002-173375 | | 6/2002 |
| JP | 2002-187271 | | 7/2002 |
| JP | 2003-175601 | A | 6/2003 |
| JP | 2004-154962 | | 6/2004 |
| JP | 2004-188990 | | 7/2004 |
| JP | 2004-275956 | | 10/2004 |
| JP | 2004-284283 | | 10/2004 |
| JP | 2005-238728 | | 9/2005 |
| JP | 2007-549599 | | 12/2005 |
| JP | 2006-75660 | | 3/2006 |
| JP | 2004-275956 | | 10/2011 |
| JP | 2004-284283 | | 10/2011 |
| KR | 2007-0087223 | | 8/2007 |
| TW | 200304014 | | 9/2003 |
| WO | 98/42517 | | 10/1998 |
| WO | WO 00/21755 | | 10/1999 |
| WO | WO 02/98576 | | 12/2002 |
| WO | 2003/026897 | | 4/2003 |
| WO | WO 2005/089324 | | 9/2005 |
| WO | WO 2006/009941 | | 1/2006 |
| WO | WO 2006/074016 | | 7/2006 |

OTHER PUBLICATIONS

Fromm, J.E., "Numerical calculation of the fluid dynamics of drop-on-demand jets," *IBM J. Res. Develop.*, 28(3) (1984).

Mills et al., "Drop-on-demand ink jet technology for color printing," *SID 82 Digest*, 13:156-157 (1982).

U.S. Appl. No. 10/800,467, Hasenbein, et al., Filed Mar. 15, 2004; Copies of Application; Pending Claims; and PAIR Transaction History.

Patent Numbers from the result set of various DIALOG searches of U.S. patent publications. Although the scope of the various searches varied, the searches were directed to identifying patent publications related to printing grey scale using ink jet technology.

International Search Report from International Application No. PCT/US05/08606.

Office Action for Chinese App. Ser. No. 200580014141.8, dated May 8, 2009.

Office Action for Chinese App. Ser. No. 200580045647.5, dated Aug. 14, 2009.

European Supplemental Search Report for Application No. EP 05 85 5801, dated Nov. 27, 2009, 8 pages.

International Preliminary Report on Patentability from PCT Application No. PCT/US2007/066159 dated Oct. 14, 2008, 11 pages.

International Search Report from PCT Application No. PCT/US2007/066159 dated Jun. 10, 2008, 16 pages.

Office action received in co-pending European application No. 05725642.2 dated Apr. 6, 2010.

Office action received in co-pending U.S. Appl. No. 11/321,941 dated Jan. 25, 2010.

Office action received in co-pending U.S. Appl. No. 11/321,941 dated Jun. 10, 2010.

Office action received in co-pending European application No. 05855801.6 dated Mar. 26, 2010.

Office action received in co-pending U.S. Appl. No. 11/279,496 dated Apr. 29, 2010.

Office action issued in co-pending Taiwan application No. 94107480 dated Jul. 7, 2010.

Office action dated Sep. 21, 2010 issued in counterpart Japanese application No. 2007-504034.

Office Action from Canadian application No. 2386737 dated Jun. 22, 2006.

Office Action from Canadian application No. 2386737 dated Jul. 11, 2007.

Office Action from Canadian application No. 2620776 dated Mar. 11, 2009.

Examination Report from European application No. 06 01 5045.5 dated Mar. 3, 2008.

Office Action from European application No. 06 01 5045.5 dated Feb. 7, 2008.
European Search Report from European application No. 06 01 5045.5 dated Oct. 24, 2006.
Examination Report from Australian application No. 2003-247683 dated Mar. 26, 2008.
Examination Report from Australian application No. 2003-247683 dated Apr. 24, 2007.
Office Action from Chinese application No. 038199505 dated Sep. 8, 2006.
Office Action from Japanese application No. 2004-519728 dated Jul. 3, 2008.
Office Action from Korean application No. 10-2004-7021621 dated May 18, 2007.
Office Action from Korean application No. 10-2004-7021621 dated Oct. 27, 2006.
Office Action from Korean application No. 10-2007-7021241 dated Mar. 17, 2009.
International Preliminary Report on Patentability from PCT Application No. PCT/US2003/20730 dated Aug. 26, 2005.
International Search Report from PCT Application No. PCT/US2003/20730 dated Mar. 25, 2004.
Office Action from Chinese application No. 200580014141.8 dated Jun. 24, 2008.
Office Action from Chinese application No. 2005800456475 dated Feb. 2, 2009.
International Preliminary Report on Patentability from PCT Application No. PCT/US2005/008606 dated Sep. 19, 2006.
International Preliminary Report on Patentability from PCT Application No. PCT/US2005/047302 dated Jul. 3, 2007.
International Search Report from PCT Application No. PCT/US2005/047302 dated Dec. 19, 2006.
Office action and response history for U.S. Appl. No. 11/279,496, filed Aug. 31, 2009.
Office action and response history for U.S. Appl. No. 11/321,941, filed Aug. 31, 2009.
Office Action from corresponding KR application No. 10-2007-7017258, dated Jun. 28, 2012, with English translation, 10 pages.
Office Action from corresponding JP application No. 2009-505550, mailed Jul. 31, 2012 with English translation, 6 pages.
Office action dated Dec. 22, 2011 issued Korean application No. 2006-7021425, 3 pages.
Office Action dated Jan. 31, 2012 issued in Japanese application No. 2011-062638, 2 pages.
Office action dated Feb. 4, 2011 issued in European application No. 07760260.5.
Office action dated Feb. 11, 2011 issued in Japanese application No. 2007-549599.
Office action dated Feb. 21, 2011 issued in Taiwan application No. 94107480.
Office Action for co-pending U.S. Appl. No. 11/321,941, dated Apr. 4, 2012, 17 pages.
Office Action from corresponding Japanese Application No. 2007-504034, mailed Apr. 24, 2012, with English Summary, 6 pages.
Office Action from corresponding Chinese Application No. 200780013181.X, mailed Mar. 13, 2012, with English translation, 9 pages.
Office Action from Japanese Application No. 2001-527993, dated Oct. 27, 2009, English translation included, 7 pages.
International Search Report for Application No. PCT/US00/41084, dated Apr. 18, 2001, 3 pages.
International Preliminary Examination Report for Application No. PCT/US00/41084, dated Dec. 28, 2001, 8 pages.
Extended European Search Report dated Jun. 26, 2009, issued in co-pending European application No. 09161286.1.
English translation of Office Action from co-pending Japanese application No. 2007-504034, issued May 6, 2011, 3 pages.
Office Action for Japanese Application No. 2011-062638 dated Jan. 27, 2012.
Office action dated Nov. 1, 2011 issued in Japanese application No. 2007-549599.
Office action dated Aug. 2, 2011 issued in Japanese application No. 2009-505550.
Office Action for co-pending U.S. Appl. No. 11/321,941, filed Aug. 29, 2011.
Office Action in Japanese Application No. 2011-062638, dated Dec. 18, 2012, 4 pages.

* cited by examiner

40usec

46usec

52usec

58usec

64usec

70usec

76usec

84usec

110usec

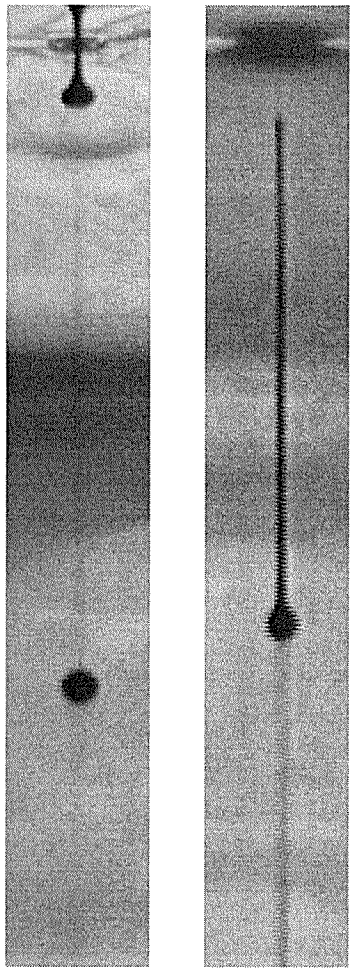
FIG. 15A
FIG. 15B
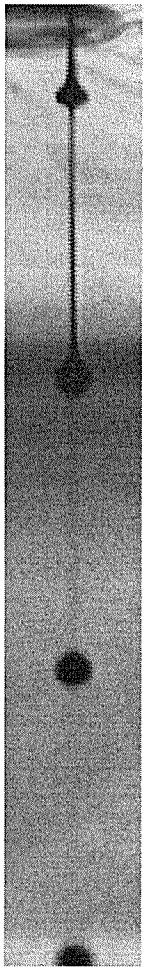
FIG. 16A
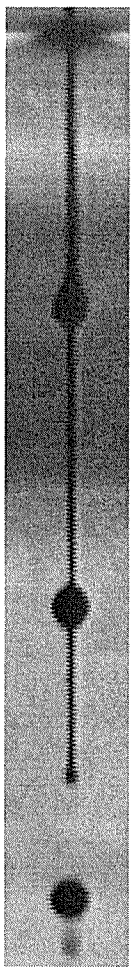
FIG. 16B

HIGH FREQUENCY DROPLET EJECTION DEVICE AND METHOD

CROSS-REFERENCE TO RELATED APPLICATIONS

This application is a continuation of U.S. patent application Ser. No. 10/800,467, entitled "HIGH FREQUENCY DROPLET EJECTION DEVICE AND METHOD," filed on Mar. 15, 2004, the entire contents of which are incorporated herein by reference.

TECHNICAL FIELD

This invention relates to droplet ejection devices and methods for driving droplet ejection devices.

BACKGROUND

Droplet ejection devices are used for a variety of purposes, most commonly for printing images on various media. They are often referred to as ink jets or ink jet printers. Drop-on-demand droplet ejection devices are used in many applications because of their flexibility and economy. Drop-on-demand devices eject a single droplet in response to a specific signal, usually an electrical waveform, or waveform.

Droplet ejection devices typically include a fluid path from a fluid supply to a nozzle path. The nozzle path terminates in a nozzle opening from which drops are ejected. Droplet ejection is controlled by pressurizing fluid in the fluid path with an actuator, which may be, for example, a piezoelectric deflector, a thermal bubble jet generator, or an electro-statically deflected element. A typical printhead has an array of fluid paths with corresponding nozzle openings and associated actuators, and droplet ejection from each nozzle opening can be independently controlled. In a drop-on-demand printhead, each actuator is fired to selectively eject a droplet at a specific target pixel location as the printhead and a substrate are moved relative to one another. In high performance printheads, the nozzle openings typically have a diameter of 50 micron or less, e.g., around 25 microns, are separated at a pitch of 100-300 nozzles/inch, have a resolution of 100 to 300 dpi or more, and provide droplet sizes of about 1 to 100 picoliters (pl) or less. Droplet ejection frequency is typically 10-100 kHz or more but may be lower for some applications.

Hoisington et al. U.S. Pat. No. 5,265,315, the entire contents of which is hereby incorporated by reference, describes a printhead that has a semiconductor printhead body and a piezoelectric actuator. The printhead body is made of silicon, which is etched to define fluid chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Deposition accuracy is influenced by a number of factors, including the size and velocity uniformity of drops ejected by the nozzles in the head and among multiple heads in a device. The droplet size and droplet velocity uniformity are in turn influenced by factors such as the dimensional uniformity of the ink paths, acoustic interference effects, contamination in the ink flow paths, and the actuation uniformity of the actuators.

Because drop-on-demand ejectors are often operated with either a moving target or a moving ejector, variations in droplet velocity lead to variations in position of drops on the media. These variations can degrade image quality in imaging applications and can degrade system performance in other applications. Variations in droplet volume lead to variations in spot size in images, or degradation in performance in other applications. For these reasons, it is usually preferable for droplet velocity, droplet volume and droplet formation characteristics to be as constant as possible throughout the operating range of an ejector.

Droplet ejector producers apply various techniques to improve frequency response, however, the physical requirements of firing drops in drop-on-demand ejectors may limit the extent to which frequency response can be improved. "Frequency response" refers to the characteristic behavior of the ejector determined by inherent physical properties that determine ejector performance over a range of droplet ejection frequencies. Typically, droplet velocity, droplet mass and droplet volume vary as a function of frequency of operation; often, droplet formation is also affected. Typical approaches to frequency response improvement may include reducing the length of the flow passages in the ejectors to increase the resonant frequency, increase in fluidic resistance of the flow passages to increase damping, and impedance tuning of internal elements such as nozzles and restrictors.

SUMMARY

Drop-on-demand droplet ejection devices may eject drops at any frequency, or combination of frequencies, up to a maximum capability of the ejection device. When operating over a wide range of frequencies, however, their performance can be affected by the frequency response of the ejector.

One way to improve the frequency response of a droplet ejector is to use a multipulse waveform with sufficiently high frequency to form a single droplet in response to the waveform. Note that the multipulse waveform frequency typically refers to the inverse of the pulse periods in the waveform, as opposed to the droplet ejection frequency referred to earlier, and to which the "frequency response" pertains. Multipulse waveforms of this type form single drops in many ejectors because the pulse frequency is high and the time between pulses is short relative to droplet formation time parameters.

In order to improve the frequency response, the waveform should generate a single large droplet, as opposed to multiple smaller drops that can form in response to a multipulse waveform. When a single large droplet is formed, the energy input from the individual pulses is averaged over the multipulse waveform. The result is that the effect of fluctuations in energy imparted to the fluid from each pulse is reduced. Thus, droplet velocity and volume remain more constant throughout the operating range.

Several pulse design parameters can be optimized to assure that a single droplet is formed in response to a multipulse waveform. In general terms, these include the relative amplitudes of individual segments of each pulse, the relative pulse widths of each segment, and the slew rate of each portion of the waveform. In some embodiments, single drops can be formed from multipulse waveforms where the voltage amplitude of each pulse gets progressively larger. Alternatively, or additionally, singles drops can result from multipulse waveforms where the time between the successive pulses is short relative to the total pulse width. The multipulse waveform can have little or no energy at frequencies corresponding to the jet natural frequency and its harmonics.

In general, in a first aspect, the invention features a method for driving a droplet ejection device having an actuator, including applying a multipulse waveform that includes two or more drive pulses to the actuator to cause the droplet ejection device to eject a single droplet of a fluid, wherein a frequency of the drive pulses is greater than a natural frequency, $f_j$, of the droplet ejection device.

Embodiments of the method can include one or more of the following features and/or features of other aspects. In some embodiments, the multipulse waveform has two drive pulses, three drive pulses, or four drive pulses. The pulse frequencies can be greater than about 1.3 $f_j$, 1.5 $f_j$. The pulse frequency can be between about 1.5 $f_j$ and about 2.5 $f_j$, such as between about 1.8 $f_j$ and about 2.2 $f_j$. The two or more pulses can have the same pulse period. The individual pulses can have different pulse periods. The two or more pulses can include one or more bipolar pulses and/or one or more unipolar pulses. In some embodiments, the droplet ejection device includes a pumping chamber and the actuator is configured to vary the pressure of the fluid in the pumping chamber in response to the drive pulses. Each pulse can have an amplitude corresponding to a maximum or minimum voltage applied to the actuator, and the amplitude of at least two of the pulses can be substantially the same. Each pulse can have an amplitude corresponding to a maximum or minimum voltage applied to the actuator, and the amplitude of at least two of the pulses can be different. For example, the amplitude of each subsequent pulse in the two or more pulses can be greater than the amplitude of earlier pulses. The droplet ejection device can be an ink jet.

In general, in a further aspect, the invention features a method that includes driving a droplet ejection device with a waveform including one or more pulses each having a period less than about 20 microseconds to cause the droplet ejection device to eject a single droplet in response to the pulses.

Embodiments of the method can include one or more of the following features and/or features of other aspects. The one or more pulses can each have a period less than about 12 microseconds, 10 microseconds, 8 microseconds, or 5 microseconds.

In general, in another aspect, the invention features a method that includes driving a droplet ejection device with a multipulse waveform including two or more pulses each having a pulse period less than about 25 microseconds to cause the droplet ejection device to eject a single droplet in response to the two or more pulses.

Embodiments of the method can include one or more of the following features and/or features of other aspects. The two or more pulses can each have a pulse period less than about 12 microseconds, 10 microseconds, 8 microseconds, or 5 microseconds. In some embodiments, the droplet has a mass between about 1 picoliter and 100 picoliters. In other embodiments, the droplet has a mass between about 5 picoliters and 200 picoliters. In still further embodiments, the droplet has a mass between about 50 picoliters and 1000 picoliters.

In general, in a further aspect, the invention features an apparatus, including a droplet ejection device having a natural frequency, $f_j$, and drive electronics coupled to the droplet ejection device, wherein during operation the drive electronics drive the droplet ejection device with a multipulse waveform that includes a plurality of drive pulses having a frequency greater than $f_j$. The harmonic content of the plurality of drive pulses at $f_j$ can be less than about 50% (e.g., less than about 25%, 10%) of the harmonic content of the plurality of the drive pulses at $f_{max}$, the frequency of maximum content.

Embodiments of the apparatus can include one or more of the following features and/or features of other aspects. During operation, the droplet ejection device can eject a single droplet in response to the plurality of pulses. The droplet ejection device can be an ink jet. In another aspect, the invention features an ink jet printhead including the aforementioned ink jet.

In general, in a further aspect, the invention features a method for driving a droplet ejection device having an actuator, including applying a multipulse waveform that includes two or more drive pulses to the actuator to cause the droplet ejection device to eject a droplet of a fluid, wherein at least about 60% of the droplet's mass is included within a radius, r, of a point in the droplet, where r corresponds to a radius of a perfectly spherical droplet given by $$r = \sqrt[3]{\frac{3}{4\pi}\frac{m_d}{\rho}},$$

where $m_d$ is the droplet's mass and ρ is the fluid density.

Embodiments of the method can include one or more of the following features and/or features of other aspects. The droplet can have a velocity of at least about 4 $ms^{-1}$ (e.g., at least about 6 $ms^{-1}$, 8 $ms^{-1}$ or more. A frequency of the drive pulses can be greater than a natural frequency, $f_j$, of the droplet ejection device. At least about 80% (e.g., at least about 90%) of the droplet's mass can be included within r of a point in the droplet.

Embodiments of the invention may have one or more of the following advantages.

The techniques disclosed herein may be used to improve frequency response performance of droplet ejection devices. Variations in the velocity of drops ejected from a droplet ejector, or jet, as a function of firing rate, can be significantly reduced. Variations in the volume of drops ejected from a droplet ejector, as a function of firing rate, can be significantly reduced. The reductions in velocity errors can lead to reduced droplet placement errors, and to improved images in imaging applications. The reduction in volume variation can lead to improved quality in non-imaging applications, and improved images in imaging applications.

These methods can also be used to improve frequency dependent ejector performance in an application, by specifying a droplet ejector design that produces drops that are, e.g., 1.5-4 or more times smaller (in volume) than is required for the application. Then by applying these techniques, the ejector can produce the droplet size required for the application. Accordingly, the techniques disclosed herein may be used to provide large droplet sizes from small droplet ejection devices and may be used to generate a large range of droplet sizes from a droplet ejection device. The large range of droplet sizes achievable using disclosed techniques can facilitate gray scale images with a large range of gray levels in ink jet printing applications. These techniques may reduce droplet tail size, thereby reducing image degradation that can occur due to droplet placement inaccuracies associated with large ink droplet tails in ink jet printing applications. These techniques can reduce inaccuracies by achieving a large droplet volume without multiple drops, because a single large droplet will put all of the fluid in one location on a moving substrate, as opposed to multiple locations when the substrate is moving relative to the ejection device. Further benefit may be obtained because single large drops can travel further and straighter than several small drops.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 15A is a photograph showing droplet ejection using a multipulse waveform. Ejection frequency is 10 kHz and droplet velocity is about 8 $ms^{-1}$.

FIG. 15B is a photograph showing droplet ejection using a single pulse waveform. Ejection frequency is 10 kHz and droplet velocity is about 8 $ms^{-1}$.

FIG. 16A is a photograph showing droplet ejection using a multipulse waveform. Ejection frequency is 20 kHz and droplet velocity is about 8 $ms^{-1}$.

FIG. 16B is a photograph showing droplet ejection using a single pulse waveform. Ejection frequency is 20 kHz and droplet velocity is about 8 $ms^{-1}$.

Like reference symbols in the various drawings indicate like elements.

DETAILED DESCRIPTION

Figure 1:
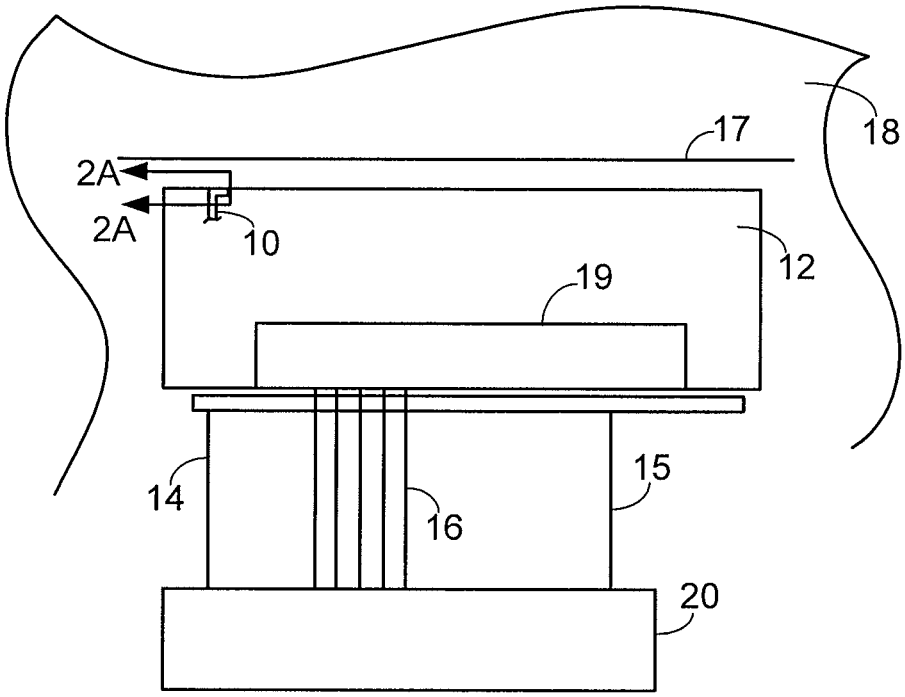
FIG. 1 is a schematic diagram of an embodiment of a printhead.

Referring to FIG. 1, a print head 12 includes multiple (e.g., 128, 256 or more) ink jets 10 (only one is shown on FIG. 1), which are driven by electrical drive pulses provided over signal lines 14 and 15 and distributed by on-board control circuitry 19 to control firing of ink jets 10. An external controller 20 supplies the drive pulses over lines 14 and 15 and provides control data and logic power and timing over additional lines 16 to on-board control circuitry 19. Ink jetted by ink jets 10 can be delivered to form one or more print lines 17 on a substrate 18 that moves relative to print head 12 (e.g., in the direction indicated by arrow 21). In some embodiments, substrate 18 moves past a stationary print head 12 in a single pass mode. Alternatively, print head 12 can also move across substrate 18 in a scanning mode.

Figure 2B:
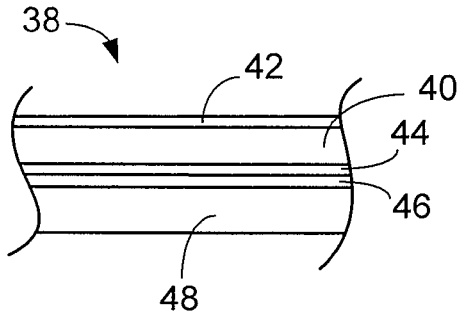
FIG. 2B is a cross-sectional view of an actuator of the ink jet shown in FIG. 2A.
Figure 2A:
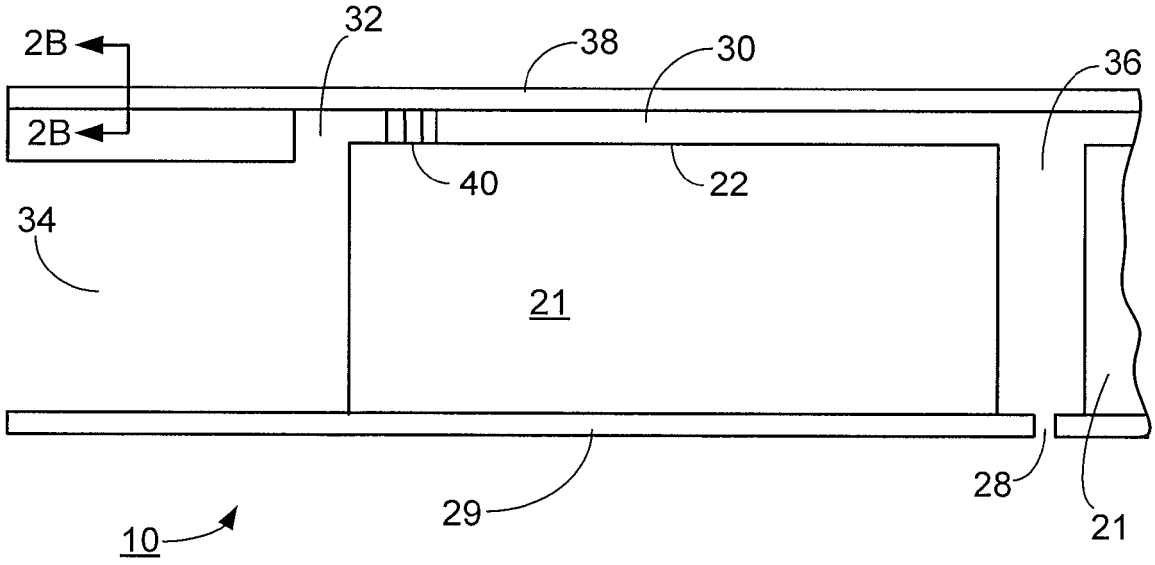
FIG. 2A is a cross-sectional view of an embodiment of an ink jet.

Referring to FIG. 2A (which is a diagrammatic vertical section), each ink jet 10 includes an elongated pumping chamber 30 in an upper face of a semiconductor block 21 of print head 12. Pumping chamber 30 extends from an inlet 32 (from a source of ink 34 along the side) to a nozzle flow path in a descender passage 36 that descends from an upper surface 22 of block 21 to a nozzle 28 opening in a lower layer 29. The nozzle size may vary as desired. For example, the nozzle can be on the order of a few microns in diameter (e.g., about 5 microns, about 8 microns, 10 microns) or can be tens or hundreds of microns in diameter (e.g., about 20 microns, 30 microns, 50 microns, 80 microns, 100 microns, 200 microns or more). A flow restriction element 40 is provided at the inlet 32 to each pumping chamber 30. A flat piezoelectric actuator 38 covering each pumping chamber 30 is activated by drive pulses provided from line 14, the timing of which are controlled by control signals from on-board circuitry 19. The drive pulses distort the piezoelectric actuator shape and thus vary the volume in chamber 30 drawing fluid into the chamber from the inlet and forcing ink through the descender passage 36 and out the nozzle 28. Each print cycle, multipulse drive waveforms are delivered to activated jets, causing each of those jets to eject a single droplet from its nozzle at a desired time in synchronism with the relative movement of substrate 18 past the print head device 12.

Referring also to FIG. 2B, flat piezoelectric actuator 38 includes a piezoelectric layer 40 disposed between a drive electrode 42 and a ground electrode 44. Ground electrode 44 is bonded to a membrane 48 (e.g., a silica, glass or silicon membrane) by a bonding layer 46. During operation, drive pulses generate an electric field within piezoelectric layer 40 by applying a potential difference between drive electrode 42 and ground electrode 44. Piezoelectric layer 40 distorts actuator 38 in response to the electric field, thus changing the volume of chamber 30.

Each ink jet has a natural frequency, $f_j$, which is related to the inverse of the period of a sound wave propagating through the length of the ejector (or jet). The jet natural frequency can affect many aspects of jet performance. For example, the jet natural frequency typically affects the frequency response of the printhead. Typically, the jet velocity remains constant (e.g., within 5% of the mean velocity) for a range of frequencies from substantially less than the natural frequency (e.g., less than about 5% of the natural frequency) up to about 25% of the natural frequency of the jet. As the frequency increases beyond this range, the jet velocity begins to vary by increasing amounts. It is believed that this variation is caused, in part, by residual pressures and flows from the previous drive pulse (s). These pressures and flows interact with the current drive pulse and can cause either constructive or destructive interference, which leads to the droplet firing either faster or slower than it would otherwise fire. Constructive interference increases the effective amplitude of a drive pulse, increasing droplet velocity. Conversely, destructive interference decreases the effective amplitude of a drive pulse, thereby decreasing droplet velocity.

The pressure waves generated by drive pulses reflect back and forth in the jet at the natural or resonant frequency of the jet. The pressure waves, nominally, travel from their origination point in the pumping chamber, to the ends of the jet, and back under the pumping chamber, at which point they would influence a subsequent drive pulse. However, various parts of the jet can give partial reflections adding to the complexity of the response.

In general, the natural frequency of an ink jet varies as a function of the ink jet design and physical properties of the ink being jetted. In some embodiments, the natural frequency of ink jet 10 is more than about 15 kHz. In other embodiments, the natural frequency of ink jet 10 is about 30 to 100 kHz, for example about 60 kHz or 80 kHz. In still further embodiments, the natural frequency is equal to or greater than about 100 kHz, such as about 120 kHz or about 160 kHz.

Figure 3:
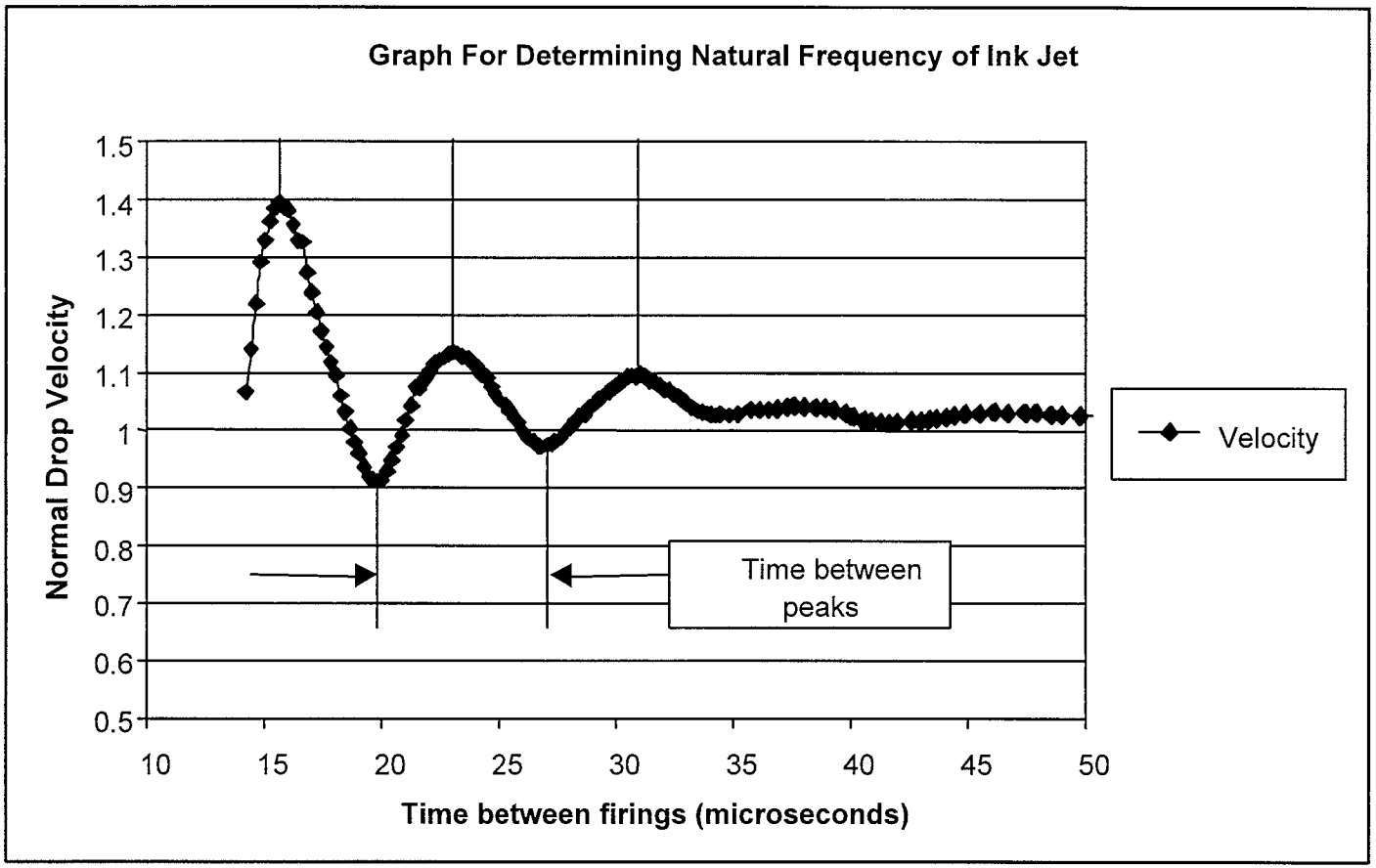
FIG. 3 is a plot of normalized droplet velocity versus time between fire pulses for droplet ejection from a droplet ejector firing at a constant rate.

One way to determine the jet natural frequency is from the jet velocity response, which can readily be measured. The periodicity of droplet velocity variations corresponds to the natural frequency of the jet. Referring to FIG. 3, the periodicity of droplet velocity variations can be measured by plotting droplet velocity versus the inverse of the pulse frequency, and then measuring the time between the peaks. The natural frequency is $1/\tau$, where $\tau$ is the time between local extrema (i.e., between adjacent maxima or adjacent minima) of the velocity vs. time curve. This method can be applied using electronic data reduction techniques, without actually plotting the data.

Droplet velocity can be measured in a variety of ways. One method is to fire the ink jet in front of a high-speed camera, illuminated by a strobe light such as an LED. The strobe is synchronized with the droplet firing frequency so that the drops appear to be stationary in a video of the image. The image is processed using conventional image analysis techniques to determine the location of the droplet heads. These are compared with the time since the droplet was fired to determine the effective droplet velocity. A typical system stores data for velocity as a function of frequency in a file system. The data can be analyzed by an algorithm to pick out the peaks or analytically derived curves can be fit to the data (parameterized by, e.g., frequency, damping, and/or velocity). Fourier analysis can also be used to determine jet natural frequency.

Figure 4A:
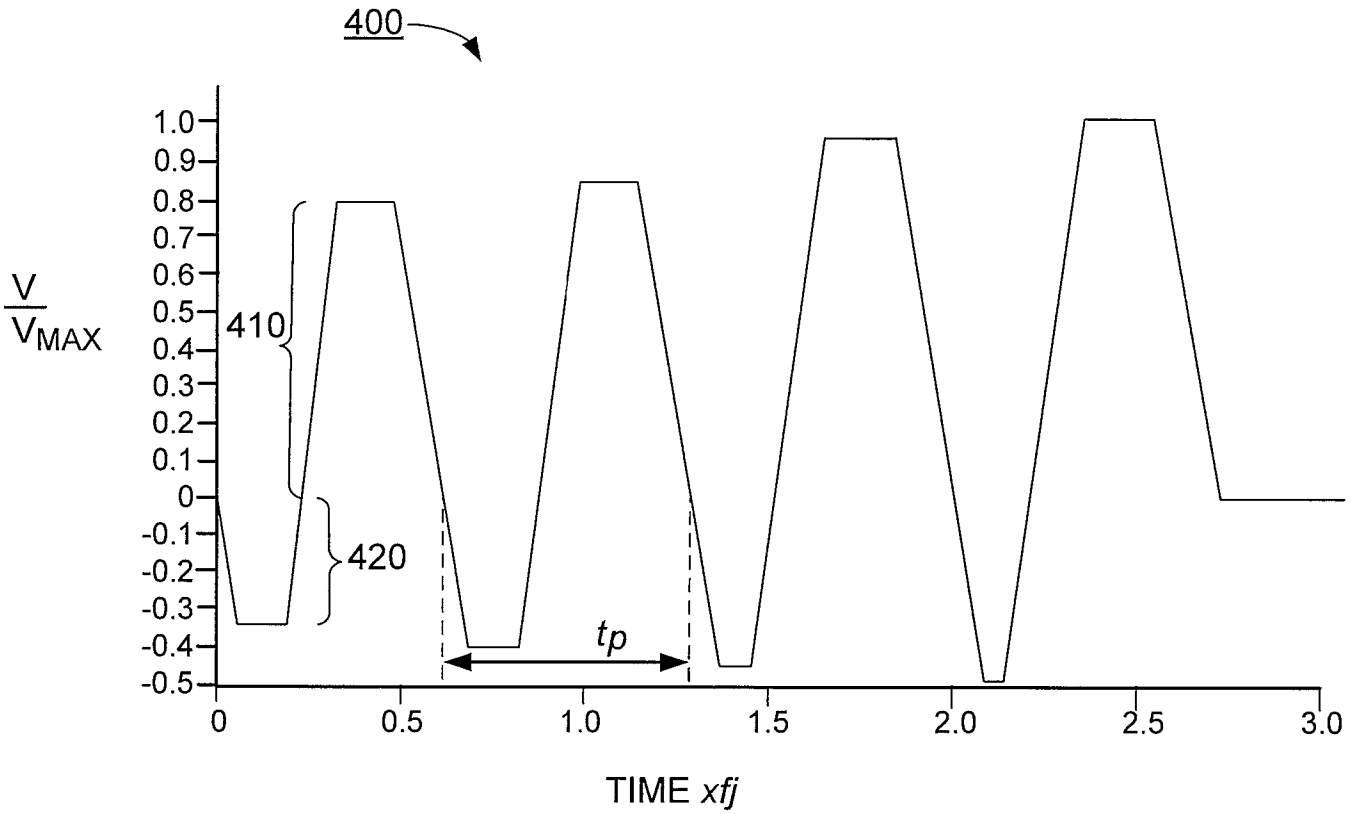
FIG. 4A is a plot of voltage versus normalized time for a bi-polar waveform for driving a droplet ejector.

During operation, each ink jet may jet a single droplet in response to a multipulse waveform. An example of a multipulse waveform is shown in FIG. 4A. In this example, multipulse waveform 400 has four pulses. Each multipulse waveform would typically be separated from subsequent waveforms by a period corresponding to an integer multiple of the jetting period (i.e., the period corresponding to the jetting frequency). Each pulse can be characterized as having a "fill" ramp, which corresponds to when the volume of the pumping element increases, and a "fire" ramp (of opposite slope to the fill ramp), which corresponds to when the volume of the pumping element decreases. In multipulse waveform 400 there is a sequence of fill and fire ramps. Typically, the expansion and contraction of the volume of the pumping element creates a pressure variation in the pumping chamber that tends to drive fluid out of the nozzle.

Each pulse has a pulse period, $\tau_p$, corresponding to the time from the start of the individual pulse segment to the end of that pulse segment. The total period of the multipulse waveform is the sum of the four pulse periods. The waveform frequency can be determined, approximately, as the number of pulses divided by the total multipulse period. Alternatively, or additionally, Fourier analysis can be used to provide a value for the pulse frequency. Fourier analysis provides a measure of the harmonic content of the multipulse waveform. The pulse frequency corresponds to a frequency, $f_{max}$, at which the harmonic content is greatest (i.e., the highest non-zero energy peak in the Fourier spectrum). Preferably, the pulse frequency of the drive waveform is greater than the natural frequency, $f_j$, of the jet. For example, the pulse frequency can be between about 1.1 and 5 times the jet natural frequency, such as between about 1.3 and 2.5 times $f_j$ (e.g., between about 1.8 and 2.3 times $f_j$, such as about twice $f_j$). In some embodiments, the pulse frequency can be equal to a multiple of the jet natural frequency, such as approximately two, three or four times the natural frequency of the jet.

Figure 4B:
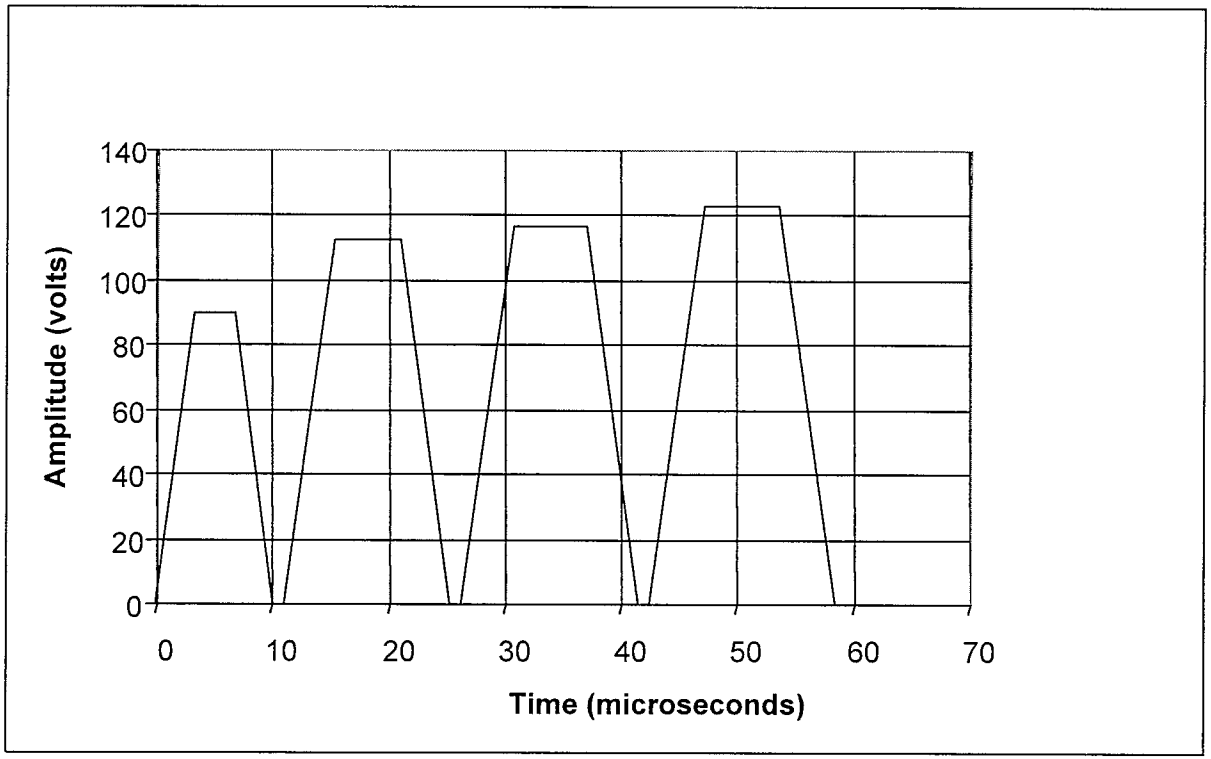
FIG. 4B is a plot of a unipolar waveform for driving a droplet ejector.

In the present embodiment, the pulses are bipolar. In other words, multipulse waveform 400 includes portions of negative (e.g., portion 410) and positive polarity (e.g., portion 420). Some waveforms may have pulses that are exclusively one polarity. Some waveforms may include a DC offset. For example, FIG. 4B shows a multipulse waveform that includes exclusively unipolar pulses. In this waveform, the pulse amplitudes and widths increase progressively with each pulse.

Figure 5A:
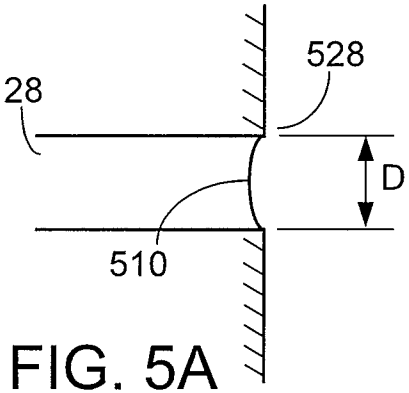
FIGS. 5A-5E are schematic diagrams showing the ejection of ink from an orifice of an ink jet in response to a multipulse waveform.
Figure 5B:
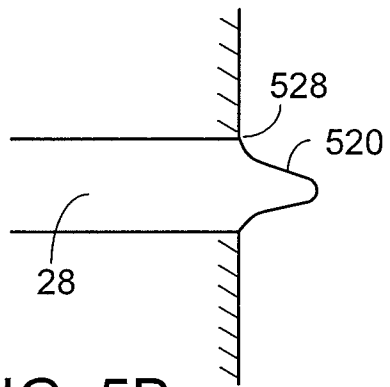
Figure 5C:
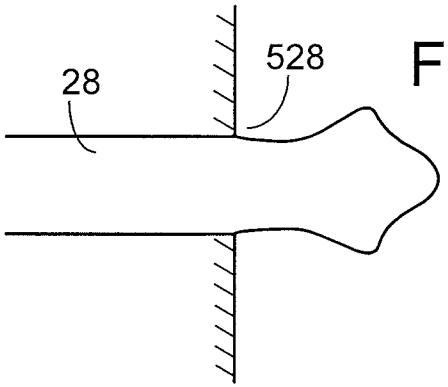
Figure 5D:
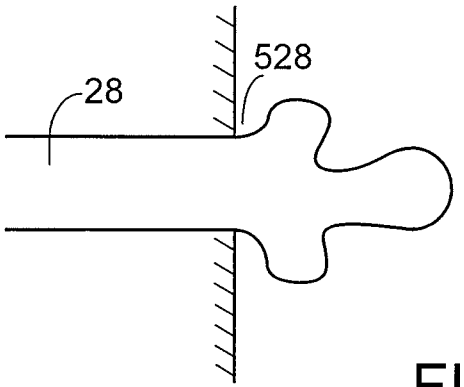
Figure 5E:
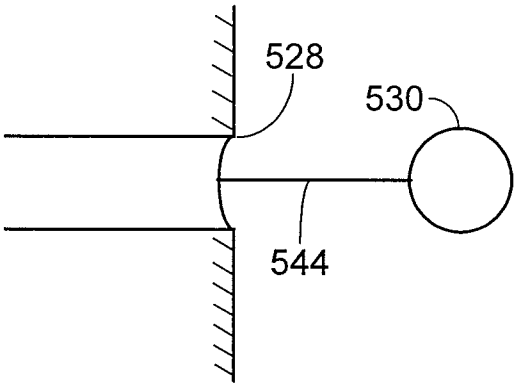

The volume of a single ink droplet ejected by a jet in response to a multipulse waveform increases with each subsequent pulse. The accumulation and ejection of ink from the nozzle in response to a multipulse waveform is illustrated in FIG. 5A-FIG. 5E. Prior to the initial pulse, ink within ink jet 10 terminates at a meniscus 510 which is curved back slightly (due to internal pressure) from an orifice 528 of nozzle 28 (see FIG. 5A). Orifice 528 has a minimum dimension, D. In embodiments where orifice 528 is circular, for example, D is the orifice diameter. In general, D can vary according to jet design and droplet size requirements. Typically, D is between about 10 μm and 200 μm, e.g., between about 20 μm and 50 μm. The first pulse forces an initial volume of ink to orifice 528, causing an ink surface 520 to protrude slightly from nozzle 28 (see FIG. 5B). Before the first partial droplet can either separate or retract, the second pulse forces another volume of ink through nozzle 28, which adds to the ink protruding from nozzle 28. The ink from the second and third pulses, as shown in FIG. 5C and FIG. 5D, respectively, increases the volume of the droplet, and adds momentum. Generally, the volumes of ink from the successive pulses, can be seen as bulges in the droplet that is forming, as shown in FIG. 5C and FIG. 5D Ultimately, nozzle 28 ejects a single droplet 530 with the fourth pulse, and meniscus 510 returns to its initial position (FIG. 5E). FIG. 5E also shows a very thin tail 544 connecting the droplet head to the nozzle. The size of this tail can be substantially smaller than would occur for drops formed using a single pulse and a larger nozzle.

Figure 6A:
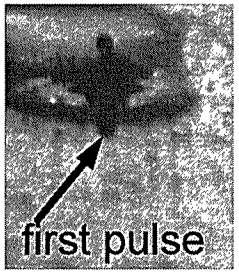
FIGS. 6A-6I are photographs showing the ejection of ink from an orifice of an ink jet in response to a multipulse waveform.
Figure 6B:
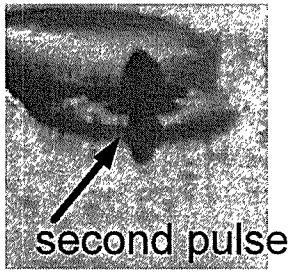
Figure 6C:
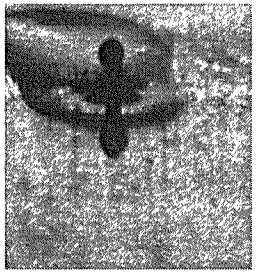
Figure 6D:
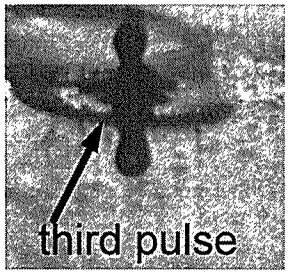
Figure 6E:
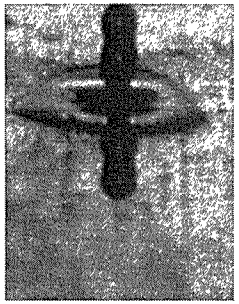
Figure 6F:
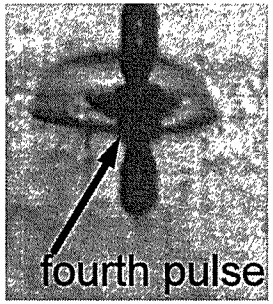
Figure 6G:
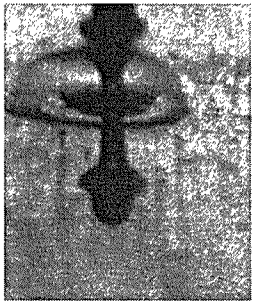
Figure 6H:
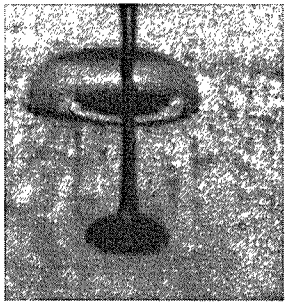
Figure 6I:
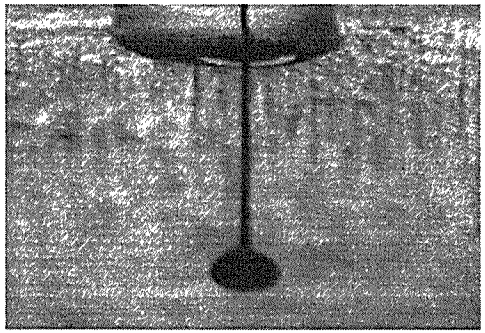

A sequence of photographs illustrating droplet ejection is shown in FIG. 6A-6I. In this example, the ink jet has a circular orifice with a 50 μm diameter. The ink jet was driven by a four-pulse multipulse waveform at a pulse frequency of approximately 60 kHz, generating a 250 picoliter droplet. Images were captured every six microseconds. The volume of ink protruding from the orifice increases with each successive pulse (FIG. 6A-6G). FIG. 6H-6I show the trajectory of the ejected droplet. Note that the ink jet surface is reflective, resulting in a mirror image of the droplet in the top half of each image.

The formation of a single large droplet with multiple fire pulses can reduce the volume of the fluid in the tail. Droplet "tail" refers to the filament of fluid connecting the droplet head, or leading part of the droplet to the nozzle until tail breakoff occurs. Droplet tails often travel slower than the lead portion of the droplet. In some cases, droplet tails can form satellites, or separate droplets, that do not land at the same location as the main body of the droplet. Thus, droplet tails can degrade overall ejector performance.

It is believed that droplet tails can be reduced by multipulse droplet firing because the impact of successive volumes of fluid changes the character of droplet formation. Later pulses of the multipulse waveform drive fluid into fluid driven by earlier pulses of the multipulse waveform, which is at the nozzle exit, forcing the fluid volumes to mix and spread due to their different velocities. This mixing and spreading can prevent a wide filament of fluid from connecting at the full diameter of the droplet head, back to the nozzle. Multipulse drops typically have either no tails or a very thin filament, as opposed to the conical tails often observed in single pulse drops. FIGS. 15A and 15B compare droplet formation of 80 picoliter drops using multipulsing of a 20 picoliter jet design and single pulsing of an 80 picoliter jet design at 10 kHz firing rates and 8 m/s droplet velocity. Similarly, FIGS. 16A and 16B compare droplet formation of 80 picoliter drops using multipulsing of a 20 picoliter jet design and single pulsing of an 80 picoliter jet design at 20 kHz firing rates and 8 m/s droplet velocity. These figures illustrate reduced tail formation for the multipulsed droplet.

As discussed previously, one method of determining the natural frequency of a jet is to perform a Fourier analysis of the jet frequency response data. Because of the non-linear nature of the droplet velocity response of a droplet ejector, the frequency response is linearized, as explained subsequently, to improve the accuracy of the Fourier analysis.

In a mechanically actuated droplet ejector, such as a piezo-driven drop-on-demand inkjet, the frequency response behavior is typically assumed to be a result of residual pressures (and flows) in the jet from previous drops that were fired. Under ideal conditions, pressure waves traveling in a channel decay in a linear fashion with respect to time. Where the amplitude of the pressure waves can be approximated from the velocity data, an equivalent frequency response can be derived that represents more linearly behaving pressure waves in the jet.

There are a number of ways to determine pressure variations in a chamber. In some droplet ejectors, such as piezo-driven ejectors, the relationship between applied voltage and pressure developed in the pumping chamber can often be assumed linear. Where non-linearities exist, they can be characterized by measurement of piezo deflection, for example. In some embodiments, pressure can be measured directly.

Alternatively, or additionally, residual pressure in a jet can be determined from the velocity response of the jet. In this approach, velocity response is converted to a voltage equivalent frequency response by determining the voltage required to fire the droplet at the measured velocity from a predetermined function. An example of this function is a polynomial, such as $$V=Av^2+Bv+C,$$

where V is the voltage, v is the velocity and A, B, and C are coefficients, which can be determined experimentally. This conversion provides an equivalent firing voltage that can be compared to the actual firing voltage. The difference between the equivalent firing voltage and the actual firing voltage is a measure of residual pressure in the jet.

When driven continuously at any particular jetting frequency, the residual pressures in the jet are the result of a series of pulse inputs spaced in time by the fire period (i.e., the inverse of the fire frequency), with the most recent pulse one fire period in the past. The voltage equivalent amplitude of the frequency response is plotted against the inverse of the frequency of the waveforms. This is equivalent to comparing the velocity response to the time since firing. A plot of the voltage equivalent versus time between pulses is, therefore, a representation of the decay of the pressure waves in the jet as a function of time. The actual driving function at each point in the voltage equivalent response versus time plot is a series of pulses at a frequency equal to the multiplicative inverse of the time at that point. If the frequency response data is taken at appropriate intervals of frequency, the data can be corrected to represent the response to a single pulse.

The response can be represented mathematically by $$R(t)=P(t)+P(2t)+P(3t)+\ldots,$$

where R(t) is the jet response to a series of pulses separated by a period t and P(t) is the jet response to a single pulse input at time t. Assuming that R(t) is a linear function of the inputs, the response equation can be manipulated algebraically to solve for P(t) given a measured R(t). Typically, because the residual energy in the jet decays with time, calculating a limited number of response times provides a sufficiently accurate result.

The above analysis can be based on frequency response data taken on a test stand that illuminates the droplet with a stroboscopic light and the jet is fired continuously so that the imaging/measurement system measures a series of pulses fired at a given frequency. Alternatively, one can repeatedly fire a jet with pairs of pulses spaced with specific time increments between them. The pairs of pulses are fired with sufficient delay between them so that residual energy in the jet substantially dies out before the next pair is fired. This method can eliminate the need to account for earlier pulses when deriving the response to a single pulse.

Figure 7:
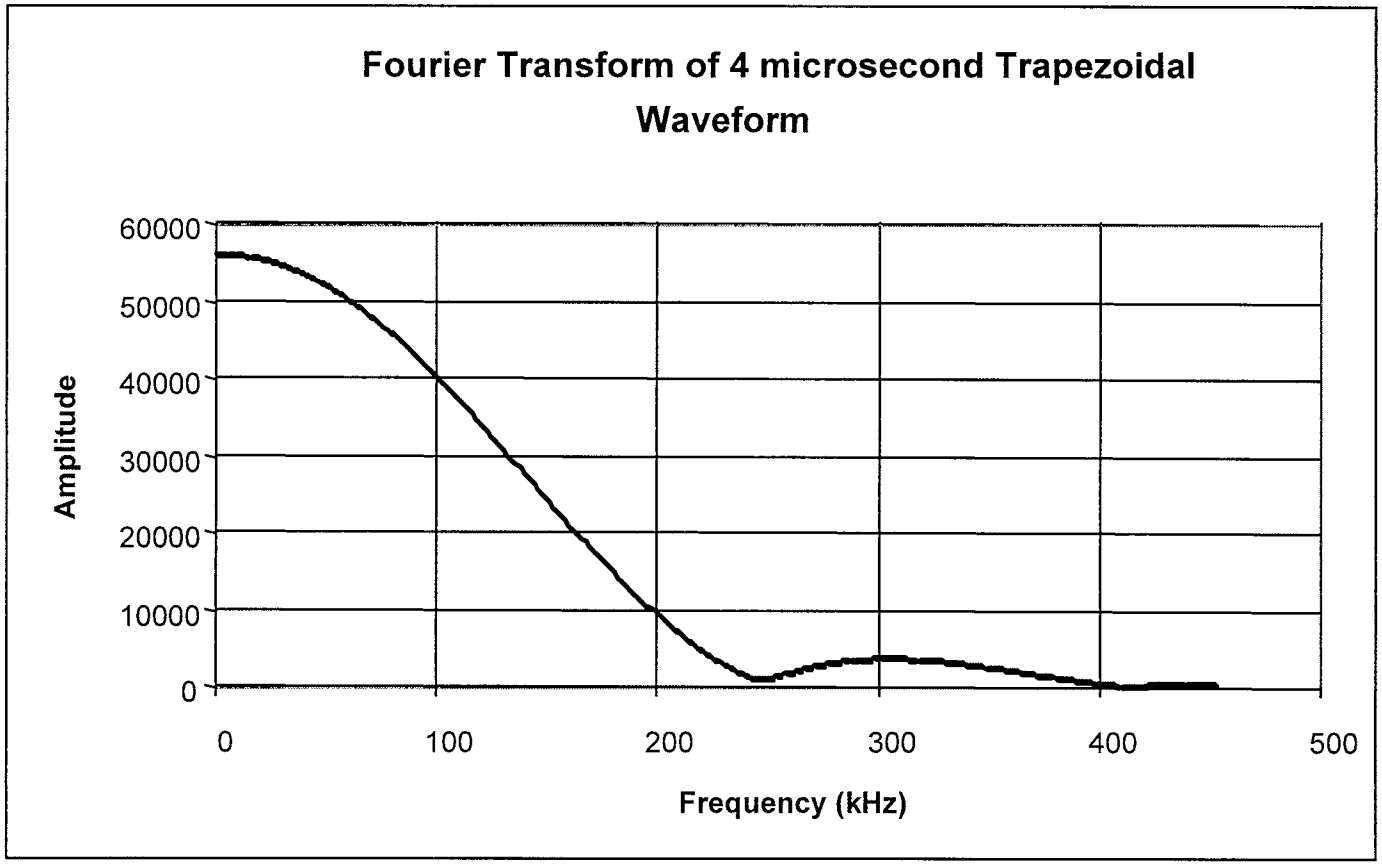
FIG. 7 is a plot of amplitude versus frequency content of a single four microsecond trapezoidal waveform determined using a Fourier transform of the waveform.

The derived frequency response is typically a reasonable approximation to a transfer function. For these tests, the pulse input to the jet is narrow relative to the frequencies that must be measured. Typically, the Fourier transform of a pulse shows frequency content at all frequencies below the inverse of the pulsewidth. The amplitude of these frequencies decreases to zero at a frequency equal to the inverse of the pulsewidth, assuming the pulse has a symmetrical shape. For example, FIG. 7 shows a Fourier transform of a four microsecond trapezoidal waveform that decays to zero at about 250 kHz.

Figure 8:
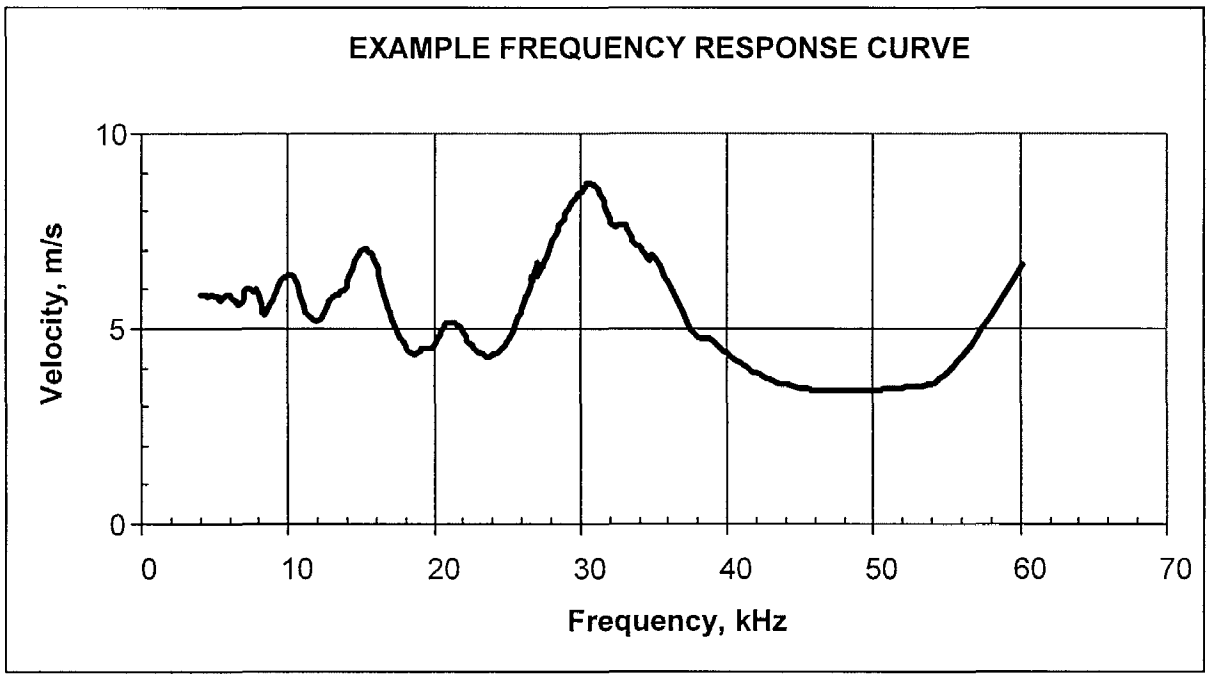
FIG. 8 is a plot showing the frequency response for an 80 picoliter droplet ejector showing the variation in droplet velocity vs. jet firing frequency from 4 to 60 kilohertz when fired with a single trapezoidal waveform.

In order to determine the frequency response of an ejector using a Fourier transform, data should be obtained of the ejector droplet velocity as a function of frequency. The ejector should be driven with a simple fire pulse, whose pulse width is as short as feasible with respect to the anticipated ejector natural period, which is equal to the inverse of the ejector natural frequency. The short period of the fire pulse assures that harmonic content of the fire pulse extends to high frequency, and thus the jet will respond as if driven by an impulse, and the frequency response data will not be substantially influenced by the fire pulse itself. FIG. 8 shows an example of a frequency response curve for a particular configuration of an 80 picoliter droplet ejector.

Data relating the voltage required to fire drops as a function of the velocity of the drops should also be acquired. This data is used to linearize the ejector response. In most droplet ejectors, the relationship between droplet velocity and voltage is non-linear, especially at low voltages (i.e., for low velocities). If the Fourier analysis is performed directly on the velocity data, it is likely that the frequency content will be distorted by the non-linear relationship between droplet velocity and pressure energy in the jet. A curve-fit such as a polynomial can be made to represent the voltage/velocity relationship, and the resulting equation can be used to transform the velocity response into a voltage equivalent response.

Figure 9:
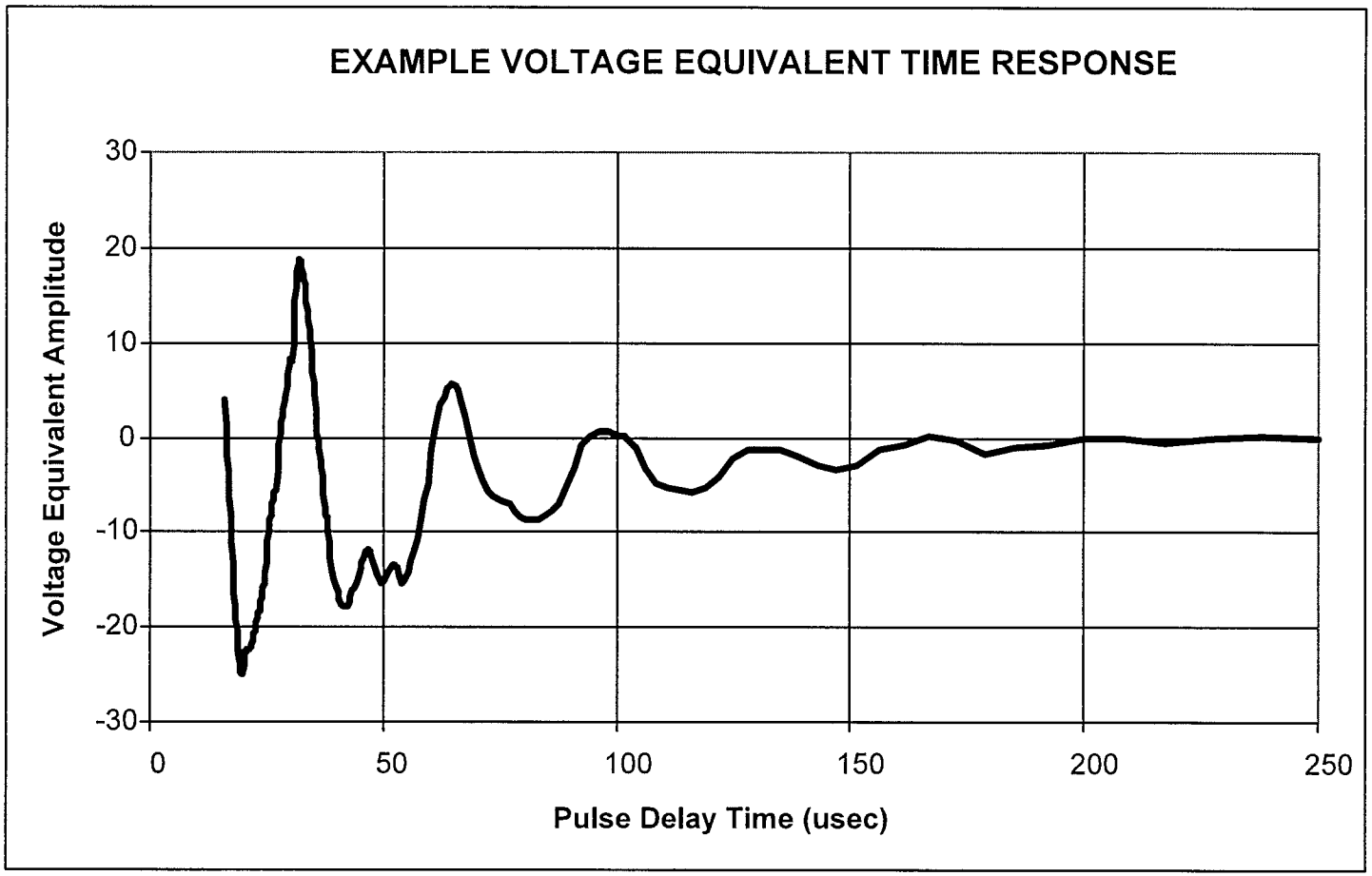
FIG. 9 is a plot of a calculated voltage equivalent time response for an exemplary 80 picoliter droplet ejector.

After transforming the velocity frequency response to a voltage, the baseline (low frequency) voltage is subtracted. The resulting value represents the residual drive energy in the jet. This is also transformed into a time response, as described previously. FIG. 9 shows an example of a voltage equivalent response as a function of pulse delay time. This curve evidences an exponential decay envelope of the frequency response.

Figure 10:
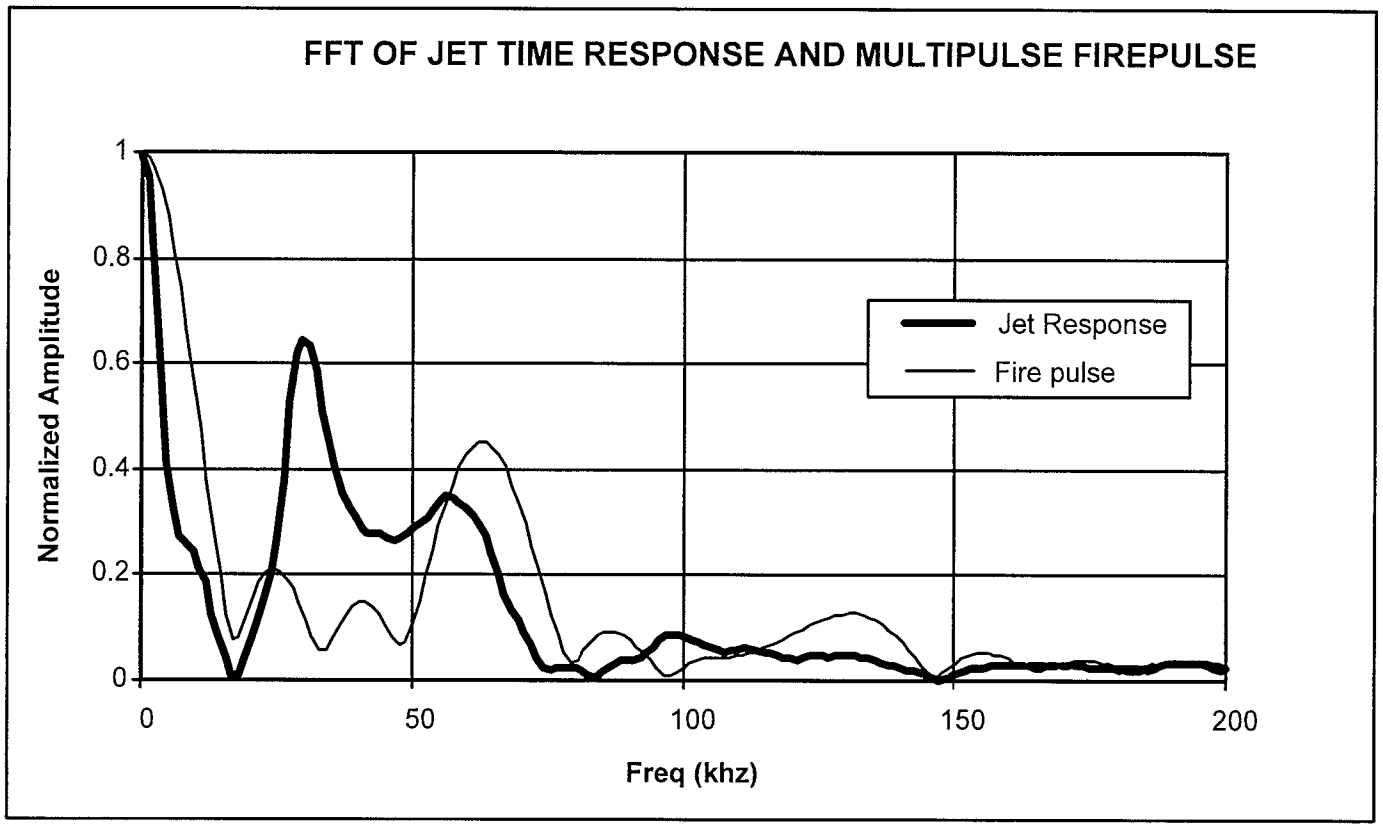
FIG. 10 is a plot of the Fourier transforms of the ejector time response and a four pulse waveform for the exemplary 80 picoliter droplet ejector.

The voltage equivalent time response data can be analyzed using a Fourier transform. FIG. 10 shows the results of a Fourier analysis on the ejector time response and the Fourier analysis of a four-pulse waveform. The dark line represents the Fourier transform of the droplet ejector (jet) time response. In the present example, this shows a strong response at 30 kHz, which is the fundamental natural frequency for this ejector. It also shows a significant second harmonic at 60 kHz.

FIG. 10 also shows the Fourier transform of a four-pulse waveform designed to drive the same ejector. As the figure shows, the waveform has low energy at the fundamental natural frequency of the ejector. Because the energy in the waveform is low at the natural frequency of the ejector, the ejector's resonant response is not substantially excited by the waveform.

Figure 11:
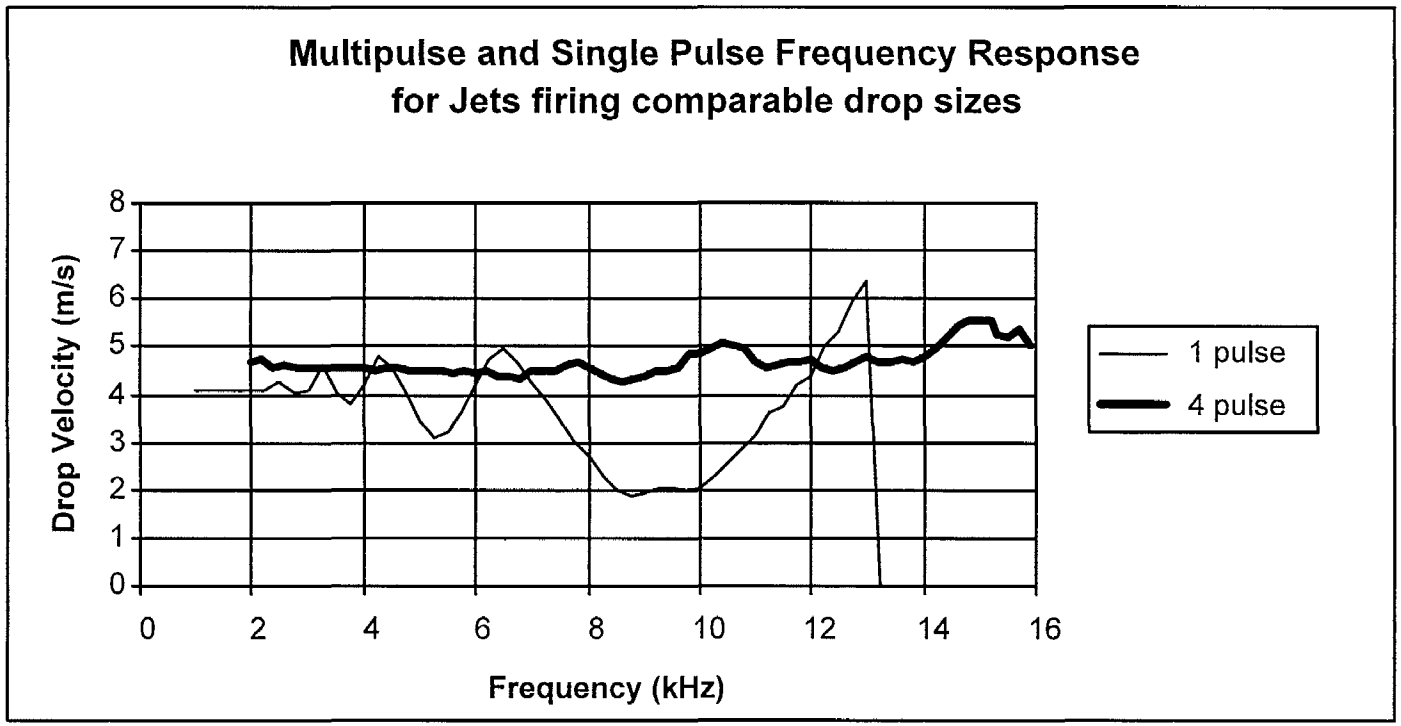
FIG. 11 is a plot comparing the frequency response of two ejectors that form similar size droplets.

FIG. 11 shows frequency response data for two different ejectors. The ejectors fire similar size drops. The darker line is data for the ejector used in the examples above fired with a four-pulse waveform. The lighter lines shows data for an ejector firing a similar-sized droplet with a single pulse waveform. The single pulse waveform response varies significantly more than the multipulse waveform.

Some ink jet configurations, with particular inks, do not produce a velocity vs. time curve that readily facilitates determination of the natural frequency. For example, inks that heavily damp reflected pressure waves (e.g., highly viscous inks) can reduce the amplitude of the residual pulses to a level where little or no oscillations are observed in the velocity vs. time curve. In some cases, a heavily damped jet will fire only at very low frequencies. Some jet firing conditions produce frequency response plots that are very irregular, or show two strong frequencies interacting so that identifying a dominant natural frequency is difficult. In such cases, it may be necessary to determine natural frequency by another method. One such method is to use a theoretical model to calculate the natural frequency of the jet from, e.g., the physical dimensions, material properties and fluid properties of the jet and ink.

Calculating the natural frequency involves determining the speed of sound in each section of the jet, then calculating the travel time for a sound wave, based on each section's length. The total travel time, $\tau_{travel}$, is determined by adding all the times together, and then doubling the total to account for the round trip the pressure wave makes through each section. The inverse of the travel time, $\tau_{travel}^{-1}$, is the natural frequency, $f_j$.

The speed of sound in a fluid is a function of the fluid's density and bulk modulus, and can be determined from the equation $$c_{sound} = \sqrt{\frac{B_{mod}}{\rho}}$$

where $c_{sound}$ is the speed of sound in meters per second, $B_{mod}$ is the bulk modulus in pascals, and $\rho$ is the density in kilograms per cubic meter. Alternatively, the bulk modulus can be deduced from the speed of sound and the density, which may be easier to measure.

In portions of the ink jet where structural compliance is large, one should include the compliance in the calculation of sound speed to determine an effective bulk modulus of the fluid. Typically, highly compliant portions include the pumping chamber because the pumping element (e.g., the actuator) is usually necessarily compliant. It may also include any other portion of the jet where there is a thin wall, or otherwise compliant structure surrounding the fluid. Structural compliance can be calculated using, e.g., a finite element program, such as ANSYS® software (commercially available from Ansys Inc., Canonsburg, Pa.), or by careful manual calculations.

In a flow channel, the compliance of a fluid, $C_F$, can be calculated from the actual bulk modulus of the fluid and the channel volume, V, where:

$$C_F = \frac{V}{B_{mod}}$$

The units of the fluid compliance are cubic meters per pascal.

In addition to the fluid compliance, the effective speed of sound in a channel should be adjusted to account for any compliance of the channel structure. The compliance of the channel structure (e.g., channel walls) can be calculated by various standard mechanical engineering formulas'. Finite element methods can be also used for this calculation, especially where structures are complex. The total compliance of the fluid, $C_{TOTAL}$, is given by:

$$C_{TOTAL}=C_F+C_S$$

where $C_S$ is the compliance of the structure. The effective speed of sound, $C_{soundEff}$, in the fluid in each section of the inject can be determined from $$c_{soundEff} = \sqrt{\frac{B_{modEff}}{\rho}},$$

where $B_{modEff}$ is the effective bulk modulus, which can be calculated from total compliance and volume of the flow channel:

$$B_{modEff} = \frac{V}{C_{TOTAL}}.$$

The frequency response of a droplet ejector can be improved through appropriate design of the waveform used to drive the ejector. Frequency response improvement can be accomplished by driving the droplet ejector with a fire pulse that is tuned to reduce or eliminate residual energy in the ejector, after the droplet is ejected. One method for accomplishing this is to drive the ejector with a series of pulses whose fundamental frequency is a multiple of the resonant frequency of the ejector. For example, the multipulse frequency can be set to approximately twice the resonant frequency of the jet. A series of pulses (e.g., 2-4 pulses) whose pulse frequency is two to four times the resonant frequency of the jet has extremely low energy content at the resonant frequency of the jet. The amplitude of the Fourier transform of the waveform at the resonant frequency of the jet, as seen in FIG. 10, is a good indicator of the relative energy in the waveform. In this case, the multipulse waveform has about 20% of the amplitude of the envelope, defined by the peaks in the Fourier transform, at the jet natural frequency.

As discussed previously, the multipulse waveform preferably results in the formation of a single droplet. The formation of a single droplet assures that the separate drive energies of the individual pulses are averaged in the droplet that is formed. Averaging the drive energies of the pulses is, in part, responsible for the flattening of the frequency response of the droplet ejector. Where the pulses are timed to a multiple of the resonant period of the ejector (e.g., 2-4 times the resonant period), the multiple pulses span a period that is an integral multiple of the ejector's resonant period. Because of this timing, residual energy from previous droplet firings is largely self-canceling, and therefore has little influence on the formation of the current droplet.

The formation of a single droplet from a multipulse waveform depends on the amplitudes and timing of the pulses. No individual droplet should be ejected by the first pulses of the pulse train, and the final volume of fluid that is driven by the final pulse should coalesce with the initial volume forming at the nozzle with sufficient energy to ensure droplet separation from the nozzle and formation of a single droplet. Individual pulse widths should be short relative to the individual droplet formation time. Pulse frequency should be high relative to droplet breakup criteria.

The first pulses of the pulse train can be shorter in duration than the later pulses. Shorter pulses have less drive energy than longer pulses of the same amplitude. Provided the pulses are short relative to an optimum pulse width (corresponding to maximum droplet velocity), the volume of fluid driven by the later (longer) pulses will have more energy than earlier pulses. The higher energy of later fired volumes means they coalesce with the earlier fired volumes, resulting in a single droplet. For example, in a four pulse waveform, pulse widths may have the following timings: first pulse width 0.15-0.25; second pulse width 0.2-0.3; third pulse width 0.2-0.3; and fourth pulse width 0.2-0.3, where the pulse widths represent decimal fractions of the total pulse width.

In some embodiments, pulses have equal width but different amplitude. Pulse amplitudes can increase from the first pulse to the last pulse. This means that the energy of the first volume of fluid delivered to the nozzle will be lower than the energy of later volumes. Each volume of fluid may have progressively larger energy. For example, in a four pulse waveform, the relative amplitudes of the individual fire pulses may have the following values: first pulse amplitude 0.25-1.0 (e.g., 0.73); second pulse amplitude 0.5-1.0 (e.g., 0.91); third pulse amplitude 0.5-1.0 (e.g., 0.95); and fourth pulse amplitude 0.75 to 1.0 (e.g., 1.0).

Other relationships are also possible. For example, in some embodiments, the later pulse can have lower amplitude than the first pulses.

Values for pulse widths and amplitudes can be determined empirically, using droplet formation, voltage and current requirements, jet sustainability, resultant jet frequency response and other criteria for evaluation of a waveform. Analytical methods can also be used for estimating droplet formation time for single drops, and droplet breakup criteria.

Preferably, the tail breakoff time is substantially longer than the period between fire pulses. The implication is that the droplet formation time is significantly longer than the pulse time and thus individual drops will not be formed.

In particular, for single droplet formation, two criteria can be evaluated to estimate tail breakoff time or droplet formation time. A time parameter, $T_0$, can be calculated from the ejector geometry and fluid properties (see, e.g., Fromm, J. E., "Numerical Calculation of the Fluid Dynamics of Drop-on-demand Jets," *IBM J. Res. Develop.*, Vol. 28 No. 3, May 1984). This parameter represents a scaling factor that relates nozzle geometry and fluid properties to droplet formation time and is derived using numerical modeling of droplet formation.

$T_0$ is defined by the equation:

$$T_0=(\rho r^3/\sigma)^{1/2}.$$

Here, r is the nozzle radius (e.g., 50 microns), ρ is the fluid density (e.g., 1 gm/cm$^3$) and σ is the fluid surface tension (e.g., 30 dyn/cm). These values correspond to the dimensions of a jet that would produce an 80 picoliter droplet for a typical test fluid (e.g., a mixture of water and glycol). Typically, the pinch-off time varies from about two to four times $T_0$, as explained in the Fromm reference. Thus, by this criterion, the breakoff time would be 130-260 microseconds for the parameter value examples mentioned.

Another calculation of tail breakoff time, discussed by Mills, R. N., Lee F. C., and Talke F. E., in "Drop-on-demand Ink Jet Technology for Color Printing," SID 82 Digest, 13, 156-157 (1982), uses an empirically derived parameter for tail breakoff time, $T_b$, given by $$T_b=A+B(\mu d)/\sigma,$$

where d is the nozzle diameter, μ is the fluid viscosity, and A and B are fitting parameters. In one example, A was determined to be 47.71 and B to be 2.13. In this example, for a nozzle diameter of 50 microns, viscosity of 10 centipoise and a surface tension of 30 dyn/cm, the tail breakoff time is about 83 microseconds.

The Rayleigh criterion for stability of a laminar jet of fluid can be used to estimate a range of firing frequencies over which individual droplet formation can be optimized. This criterion can be expressed mathematically as $$k=\pi d/\lambda.$$

Here, k is a parameter derived from the stability equation for a cylindrical jet of fluid. The stability of the jet is determined by whether a surface perturbation (such as a disturbance created by a pulse) will grow in amplitude. λ is the wavelength of the surface wave on the ejector. The parameter k should be between zero and one for the formation of separate drops. Since λ is equal to the droplet velocity, v, divided by the pulse frequency, f, this equation can be recast in terms of frequency and velocity. Thus, for formation of separate droplets $$f\leqq v/(\pi d).$$

For example, in an ejector where d=50 microns, and v=8 m/s, according to this analysis f should be less than about 50 kHz for effective droplet separation. In this example, a multipulse fire frequency of approximately 60 kHz should help provide single droplets for a multipulse waveform.

The mass of each droplet can be varied by varying the number of pulses in the multipulse waveform. Each multipulse waveform can include any number of pulses (e.g., two, three, four, five, or more pulses), selected according to the droplet mass desired for each droplet jetted.

In general, droplet mass can vary as desired. Larger drops can be generated by increasing pulse amplitudes, pulse widths, and/or increasing the number of fire pulses in the multipulse waveform. In some embodiments, each ejector can eject drops that vary over a range of volumes such that the mass of the smallest possible droplet is about 10% of the largest possible droplet mass (e.g., about 20%, 50%). In some embodiments, an ejector can eject drops within a range of droplet masses from about 10 to 40 picoliter, such as between about 10 and 20 picoliter. In other embodiments droplet mass can be varied between 80 and 300 picoliter. In further embodiments, droplet mass may vary between 25 and 120 picoliter. The large variation in possible droplet size may be particularly advantageous in providing a variety of gray levels in applications utilizing gray scale printing. In some applications, a range of about 1 to 4 on droplet mass with two mass levels is sufficient for effective gray scale.

A pulse train profile can be selected to tailor further droplet characteristics in addition to droplet mass. For example, the length and volume of a droplet's tail can be substantially reduced by selecting an appropriate pulse train profile. A droplet's tail refers to a volume of ink in the droplet that trails substantially behind the leading edge of the droplet (e.g., any amount of fluid that causes the droplet shape to differ from essentially spherical) and will likely cause performance degradation. Fluid that is more than two nozzle diameters behind the leading edge of the droplet typically has a detrimental impact on performance. Droplet tails typically result from the action of surface tension and viscosity pulling the final amount of fluid out of the nozzle after the droplet is ejected. The tail of a droplet can be the result of velocity variations between different portions of a droplet because slower moving ink ejected from the orifice at the same time or later than faster moving ink will trail the faster moving ink. In many cases, having a large tail can degrade the quality of a printed image by striking a different portion of a moving substrate than the leading edge of the droplet.

In some embodiments, the tail can be sufficiently reduced so that jetted drops are substantially spherical within a short distance of the orifice. For example, at least about 60% (e.g., at least about 80%) of a droplet's mass can be included within a radius, r, of a point in the droplet, where r corresponds to the radius of a perfectly spherical droplet and is given by $$r = \sqrt[3]{\frac{3}{4\pi}\frac{m_d}{\rho}},$$

where $m_d$ is the droplet's mass and ρ is the ink density. In other words, where at least about 60% of the droplet's mass is located within r of a point in the droplet, less than about 40% of the droplet's mass is located in the tail. In some embodiments, less than about 30% (e.g., less than about 20%, 10%, 5%) of the droplet's mass is located in the droplet tail. Less than about 30% (e.g., less than about 20%, 10%, 5%) of the droplet's mass can be located in the droplet tail for droplet velocities more than about 4 $ms^{-1}$ (e.g., more than about 5 $ms^{-1}$, 6 $ms^{-1}$, 7 $ms^{-1}$, 8 $ms^{-1}$).

The proportion of fluid in the droplet tail can be determined from photographic images of droplets, such as those shown in FIG. 15A-B and FIG. 16A-B. In particular, the proportion of fluid in the droplet tail can be extrapolated from the relative area of the droplet body and droplet tail in the image.

Pulse parameters influencing droplet characteristics are typically interrelated. Furthermore, droplet characteristics can also depend on other characteristics of the droplet ejector (e.g., chamber volume) and fluid properties (e.g., viscosity and density). Accordingly, multipulse waveforms for producing a droplet having a particular mass, shape, and velocity can vary from one ejector to another, and for different types of fluids.

Figure 12:
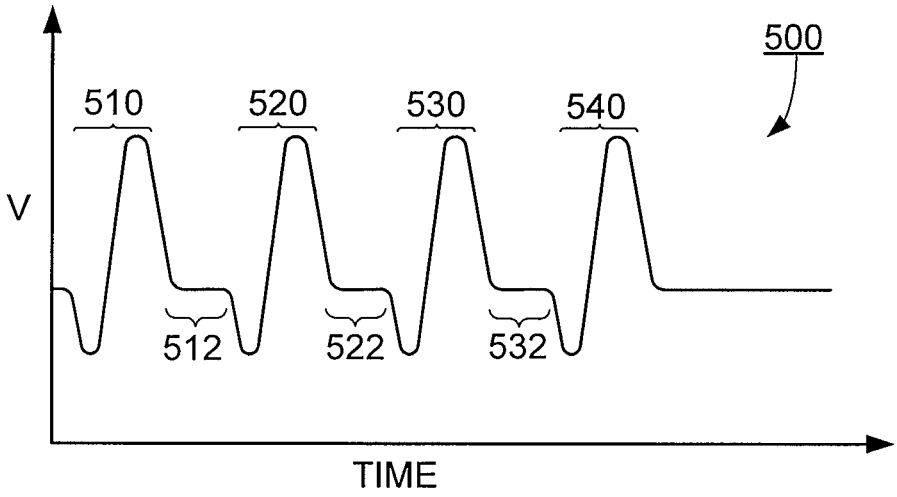
FIG. 12 is a plot of voltage versus time for a multipulse waveform in which there is a delay period between adjacent pulses.

Although multipulse waveforms described previously consist of continuous pulses, in some embodiments, an ejector can generate a droplet with a multipulse waveform that includes discontinuous pulses. Referring to FIG. 12, an example of a multipulse waveform that includes discontinuous pulses is multipulse waveform 500, which includes pulses 510, 520, 530, and 540. The first pulse 510 of the total waveform is separated from the second pulse 520 of the total waveform by a null period, 512. The second pulse 520 is separated from the third pulse 530 by a null period 522. Similarly, the fourth pulse 540 is separated from the third pulse 530 by null periods 532. One way of characterizing the relationship between pulse period and delay period is by the pulse duty cycle. As used herein, the duty cycle of each pulse refers to the ratio of the pulse period to the period between pulses (i.e., pulse period plus delay period). A duty cycle of one, for example, corresponds to pulses with zero delay period, such as those shown in FIG. 4A. Where pulses are separated by a finite delay period, the duty cycle is less than one. In some embodiments, pulses in a multipulse waveform may have a duty cycle of less than one, such as about 0.8, 0.6, 0.5 or less. In some embodiments, delay periods can be utilized between waveforms to reduce the effect of interference between subsequent pulses and earlier pulses. For example, where damping of the reflected pulse is low (e.g., where the ink viscosity is low), it may be desirable to offset adjacent pulses in time to reduce these interference effects.

Figure 13:
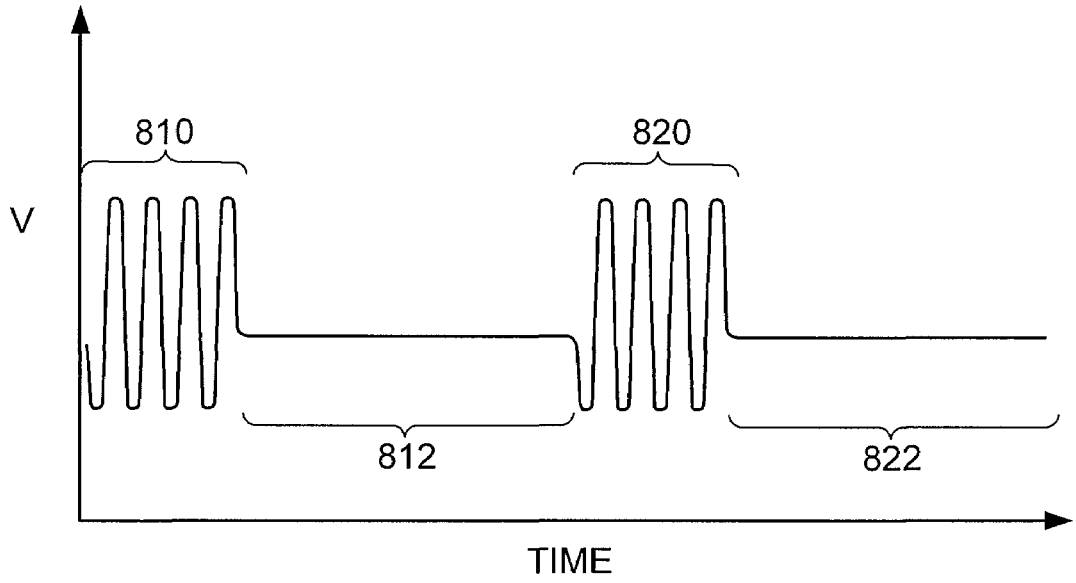
FIG. 13 is a plot of voltage versus time for a drive signal including multiple multipulse waveforms.
Figure 14:
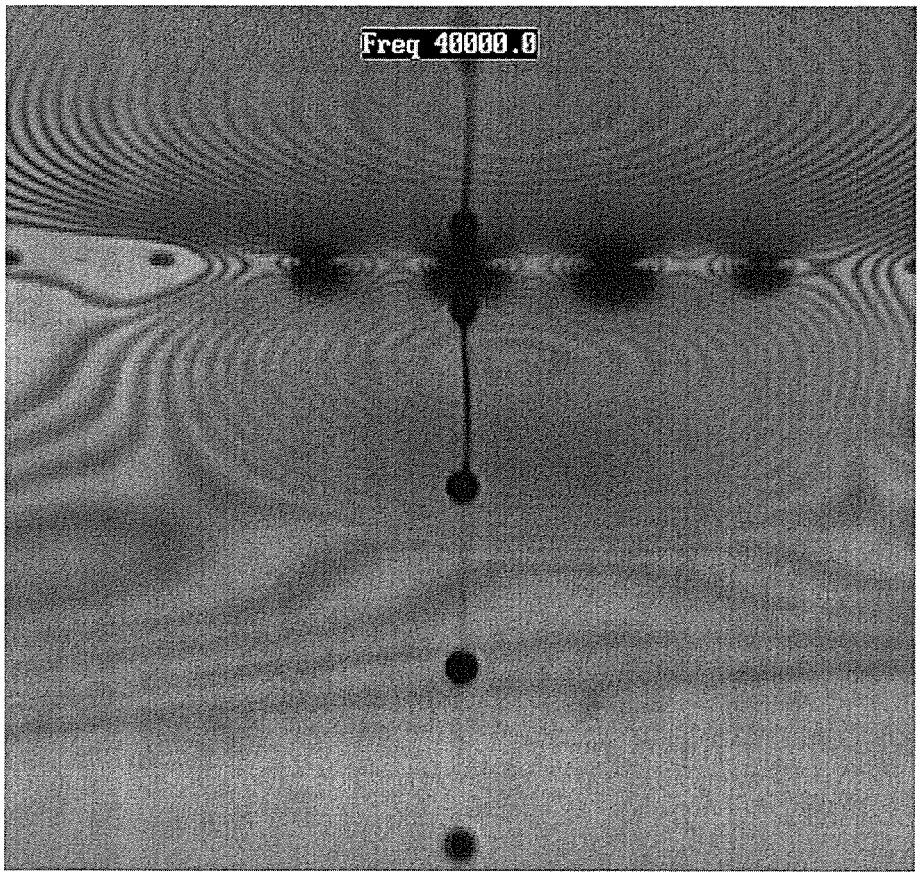
FIG. 14 is a photograph showing the ejection of multiple drops from an ink jet orifice using a multipulse waveform.

Referring to FIG. 13 and FIG. 14, during printing using an ink jet printhead, multiple drops are jetted from each ink jet by driving the ink jet with multiple multipulse waveforms. As shown in FIG. 13, multipulse waveforms 810 and 820 are followed by delay periods 812 and 822, respectively. One droplet is ejected in response to multipulse waveform 810, and another droplet is jetted in response to multipulse waveform 820. Generally, the profile of adjacent multipulse waveforms can be the same or different, depending on whether or not similar drops are required.

The minimum delay period between multipulse waveforms typically depends on printing resolution and the multipulse waveform duration. For example, for a relative substrate velocity of about one meter per second, multipulse waveform frequency should be 23.6 kHz to provide a printing resolution of 600 dpi. Thus, in this case, adjacent multipulse waveforms should be separated by 42.3 microseconds. Each delay period is thus the difference between 42.3 microseconds and the duration of the multipulse waveform.

FIG. 14 shows an example of an ink jet jetting multiple drops from a circular orifice having a 23 μm diameter. In this embodiment, the drive pulses were approximately 16 microseconds in duration and 25 microseconds apart, due to a firing rate of 40 kHz.

FIG. 15A-B and FIG. 16A-B show comparisons of two jets firing 80 picoliter drops at two different frequencies. One jet, shown in FIGS. 15A and 16A, is a smaller jet (nominally 20 picoliters) and uses a four pulse waveform to eject an 80 picoliter droplet. The other jet, shown in FIGS. 15B and 16B, is an 80 picoliter jet using a single pulse waveform. The droplets formed with multipulse waveforms also exhibit reduced tail mass compared to those formed with single pulse waveforms.

In general, the drive schemes discussed can be adapted to other droplet ejection devices in addition to those described above. For example, the drive schemes can be adapted to ink jets described in U.S. patent application Ser. No. 10/189,947, entitled "PRINTHEAD," by Andreas Bibl and coworkers, filed on Jul. 3, 2003, and U.S. patent application Ser. No. 09/412,827, entitled "PIEZOELECTRIC INK JET MODULE WITH SEAL," by Edward R. Moynihan and coworkers, filed on Oct. 5, 1999, the entire contents of which are hereby incorporated by reference.

Moreover, as discussed previously, the foregoing drive schemes can be applied to droplet ejection devices in general, not just to those that eject ink. Examples of other droplet ejection apparatus include those used to deposit patterned adhesives or patterned materials for electronic displays (e.g., organic LED materials).

A number of embodiments of the invention have been described. Nevertheless, it will be understood that various modifications may be made without departing from the spirit and scope of the invention. Accordingly, other embodiments are within the scope of the following claims.

What is claimed is:

1. A method for driving a droplet ejection device having an actuator, comprising:

applying a multipulse waveform comprising two or more drive pulses to the actuator to cause the droplet ejection device to eject a single droplet of a fluid, wherein each of the two or more drive pulses has an amplitude, the amplitude of a final pulse of the two or more drive pulses being greater than the amplitude of an earlier pulse of the two or more drive pulses, wherein a frequency of the drive pulses is greater than a natural frequency, $f_j$, of the droplet ejection device.

2. The method of claim 1, wherein the multipulse waveform has three drive pulses.

3. The method of claim 1, wherein the multipulse waveform has four drive pulses.

4. The method of claim 3, wherein the amplitude of each drive pulse of the four drive pulses has a relative value with the fourth drive pulse having the greatest amplitude and relative value of 1.0, the first drive pulse having a value between 0.25 and 1.0, the second drive pulse having a value between 0.5 and 1.0, and the third drive pulse having a value between 0.5 and 1.0.

5. The method of claim 1, wherein the frequency of the drive pulses is greater than about 1.3 $f_j$.

6. The method of claim 5, wherein the frequency of the drive pulses is greater than about 1.5 $f_j$.

7. The method of claim 1, wherein the two or more drive pulses comprise one or more bipolar pulses.

8. The method of claim 1, wherein the two or more drive pulses comprise one or more unipolar pulses.

9. The method of claim 1, wherein the droplet ejection device comprises a pumping chamber and the actuator comprises a piezoelectric material and is configured to vary the pressure of the fluid in the pumping chamber in response to the drive pulses.

10. A method for driving a droplet ejection device having an actuator, comprising:

applying a multipulse waveform comprising two or more fire pulses to the actuator to cause the droplet ejection device to eject a single droplet of a fluid, wherein each fire pulse of the two or more fire pulses causes the fluid to protrude from a nozzle of the droplet ejection device, and a frequency of the fire pulses is greater than a natural frequency, $f_j$, of the droplet ejection device.

11. The method of claim 10, wherein the multipulse waveform has four fire pulses.

12. The method of claim 10, wherein the frequency of the fire pulses is greater than about 1.3 $f_j$.

13. The method of claim 10, wherein the individual pulses of the two or more fire pulses have different pulse periods.

14. The method of claim 10, wherein the two or more fire pulses comprise one or more bipolar pulses.

15. The method of claim 10, wherein the two or more fire pulses comprise one or more unipolar pulses.

16. The method of claim 10, wherein the droplet ejection device comprises a pumping chamber and the actuator comprises a piezoelectric material configured to vary a pressure of the fluid in the pumping chamber in response to the fire pulses.

17. A method for driving a droplet ejection device having an actuator, comprising:

applying a multipulse waveform comprising two or more drive pulses to the actuator to cause the droplet ejection device to eject a single droplet of a fluid, wherein each pulse has a pulse width, the pulse width of the final pulse being greater than the pulse width of an earlier pulse of the two or more drive pulses, and a frequency of the drive pulses is greater than a natural frequency, $f_j$, of the droplet ejection device.

18. The method of claim 17, wherein the multipulse waveform has four drive pulses.

19. The method of claim 18, wherein the four drive pulses have a total pulse width, and each pulse width represents a decimal fraction of the total pulse width, the pulse width of a first drive pulse is 0.15 to 0.25, the pulse width of a second drive pulse is 0.2 to 0.3, the pulse width of a third drive pulse is 0.2 to 0.3, and the pulse width of a fourth pulse is 0.2 to 0.3 of the total pulse width.

20. The method of claim 17, wherein the frequency of the drive pulses is greater than about 1.3 $f_j$.

21. The method of claim 20, wherein the frequency of the drive pulses is greater than about 1.5 $f_j$.

22. The method of claim 17, wherein the individual pulses of the two or more drive pulses have different pulse periods.

23. The method of claim 17, wherein the two or more drive pulses comprise one or more bipolar pulses.

24. The method of claim 17, wherein the two or more drive pulses comprise one or more unipolar pulses.

* * * * *

UNITED STATES PATENT AND TRADEMARK OFFICE

CERTIFICATE OF CORRECTION

PATENT NO. : 8,459,768 B2
APPLICATION NO. : 11/864250
DATED : June 11, 2013
INVENTOR(S) : Robert A. Hasenbein et al.

It is certified that error appears in the above-identified patent and that said Letters Patent is hereby corrected as shown below:

Title Page 7, Item (56) Column 2 (Other Publications), Line 1, after "issued" insert -- in --

In the Claims

Column 18, Line 22, In Claim 17, delete "each pulse" and insert -- each drive pulse of the two or more drive pulses --

Column 18, Line 22, In Claim 17, delete "of the" and insert -- of a --

Column 18, Line 23, In Claim 17, after "final pulse" insert -- of the two or more drive pulses --

Signed and Sealed this
Twentieth Day of August, 2013

Teresa Stanek Rea

Teresa Stanek Rea
*Acting Director of the United States Patent and Trademark Office*